US005888708A

United States Patent [19]

Fukui et al.

[11] Patent Number: 5,888,708

[45] Date of Patent: Mar. 30, 1999

[54] DEVELOPMENT PROCESSING METHOD

[75] Inventors: Kouta Fukui; Senzo Sasaoka, both of Kanagawa, Japan

[73] Assignee: Fuji Photo Film Co., Ltd., Kanagawa, Japan

[21] Appl. No.: 14,570

[22] Filed: Jan. 28, 1998

[30] Foreign Application Priority Data

Jan. 28, 1997 [JP] Japan ..... 9-014356

[51] Int. Cl.[6] ..... G03C 5/29

[52] U.S. Cl. ..... 430/436; 430/264; 430/440; 430/442; 430/446

[58] Field of Search ..... 430/264, 436, 430/440, 442, 446

[56] References Cited

U.S. PATENT DOCUMENTS

| | | | |
|---|---|---|---|
| 4,746,593 | 5/1988 | Kitchin et al. | 430/264 |
| 4,786,587 | 11/1988 | Kuwabara | 430/566 |
| 5,766,820 | 6/1998 | Fukawa et al. | 430/264 |

FOREIGN PATENT DOCUMENTS 0 793 140 A1 9/1997 European Pat. Off. .

*Primary Examiner*—Hoa Van Le
*Attorney, Agent, or Firm*—Sughrue, Mion, Zinn, Macpeak & Seas, PLLC

[57] ABSTRACT

A development processing method comprising developing a silver halide photographic material with a developing solution, (i) wherein the silver halide photographic material comprises a support having thereon at least one light-sensitive silver halide emulsion layer and contains: (a) at least two kinds of light-sensitive silver halide emulsions which are each spectrally sensitized and have sensitivities different from each other with respect to a certain exposure wavelength; and (b) at least one hydrazine derivative in at least one of the silver halide emulsion layer and other hydrophilic colloidal layers, and (ii) wherein the developing solution is substantially free from a dihydroxybenzene compound, has a pH of from 9.0 to 10.5 and contains: (1) at least one ascorbic acid developing agent and (2) at least one auxiliary developing agent represented by the following general formula (I):

(I)

wherein $R_1$, $R_2$, $R_3$ and $R_4$, which may be the same or different, each represents a hydrogen atom or a substituent group; and $R_5$ and $R_6$, which may be the same or different, each represents an alkyl group, an aryl group, an aralkyl group or a heterocyclic group.

6 Claims, No Drawings

DEVELOPMENT PROCESSING METHOD

FIELD OF THE INVENTION

The present invention relates to a method for forming an ultrahigh-contrast image using a silver halide photographic light sensitive material, and more particularly to a development processing method which makes it possible to obtain an ultrahigh-contrast image with a developing solution which is less contaminated and contains substantially no dihydroxybenzene developing agent.

BACKGROUND OF THE INVENTION

In the field of graphic arts, in order to improve the reproduction of continuous gradation images with halftone dot images or the reproduction of line images, image formation systems exhibiting ultrahigh-contrast (particularly, γ is 10 or more) photographic characteristics are required.

As methods for obtaining high-contrast photographic characteristics, lithographic development systems utilizing the so-called "infectious development effect" have been used for long. However, they have the disadvantage that the developing solutions are unstable and hard to use. In contrast, as methods using more stable developing solutions, there are methods described in U.S. Pat. Nos. 4,224,401, 4,168,977, 4,166,742, 4,311,781, 4,272,606, 4,221,857, 4,332,878, 4,634,661, 4,618,574, 4,269,922, 5,650,746 and 4,681,836.

These image formation systems are systems for processing hydrazine derivative-containing silver halide photographic materials of the surface latent image type with stable MQ developing solutions (in which hydroquinone is used in combination with a p-aminophenol) or PQ developing solutions (in which hydroquinone is used in combination with a 1-phenyl-3-pyrazolidone compound) having a pH of 11.0 to 12.3 to obtain ultrahigh-contrast negative images in which γ exceeds 10. According to these methods, ultrahigh-contrast and high-speed photographic characteristics can be obtained, and sulfites can be added in high concentration to the developing solutions. Therefore, the stability against air oxidation of the developing solutions is far improved, compared with the conventional lithographic developing solutions.

U.S. Pat. No. 4,269,929 (JP-A-61-267759 (the term "JP-A" as used herein means an "unexamined published Japanese patent application")), U.S. Pat. No. 4,737,452 (JP-A-60-179734), U.S. Pat. No. 5,104,769 and U.S. Pat. No. 4,798,780, JP-A-1-179939, JP-A-1-179940, U.S. Pat. Nos. 4,998,604 and 4,994,365, and JP-A-8-272023 disclose methods of using high-active hydrazine nucleating agents and nucleating accelerators for obtaining ultrahigh-contrast images by use of stable developing solutions having a pH of less than 11.0. It is also disclosed that silver halide emulsions high in silver chloride content and chemically sensitized have high nucleating activity. However, the use of the high-active hydrazine nucleating agents and nucleating accelerators as described above or high-active emulsions raises the problem of uneven density at the time of an output of a definite halftone dot area, which is called processing unevenness.

On the other hand, it is known that enediols such as ascorbic acid function as developing agents, and attention is given to them as developing agents having no ecological and toxicological problems. For example, in U.S. Pat. Nos. 2,688,549 and 3,826,654, it is described that image formation is possible under high alkaline conditions of pH 12 or higher. However, high-contrast images can not be obtained by these image formation methods.

Some attempts have been made to increase the contrast in development systems using ascorbic acid. For example, Zwicky describes that the use of ascorbic acid as a sole developing agent causes a kind of lithographic effect to appears (*J. Phot. Sci.,* 27, 185 (1979)). However, this system was considerably low in the contrast, compared with hydroquinone development systems. Further, U.S. Pat. No. T896,022 and JP-B-49-46939 (the term "JP-B" as used herein means an "examined Japanese patent publication") disclose a system in which ascorbic acid is used in combination with a bis-quaternary ammonium salt. This system has the development accelerating effect, but scarcely shows the contrast increasing effect. JP-A-3-249756 and JP-A-4-32838 also describe the effect of using ascorbic acid in combination with a quaternary salt. However, the contrast of images obtained is not sufficient. Furthermore, JP-A-5-88306 describes that high contrast is obtained by using ascorbic acid as a sole developing agent and keeping the pH at 12.0 or higher. However, this system-also has a problem with respect to the stability of a developing solution because of its high pH.

There is an example in which a particular developing solution containing ascorbic acid and a hydrazine derivative as main components is used to obtain a development system high in sensitivity and low in stain and fog (U.S. Pat. No. 3,730,727). However, no reference is made to contrast enhancement.

It is known that photographic materials containing hydrazine are processed with ascorbic acid developing solutions, and disclosed in U.S. Pat. No. 5,236,816 and WO 93/11456. However, both are insufficient in terms of the contrast. In the latter, the contrast is enhanced by adding an amine to a developing solution, but this is environmentally unfavorable. A developing method has therefore been desired in which toxicologically preferable ascorbic acid is used as a developing agent to obtain a high-contrast image. Previously, Metol or phenidone compounds have been used as auxiliary developing agents for the ascorbic acid developing solutions. Also in the above-mentioned patents, either of these auxiliary developing agents is used.

Further, a high-contrast photographic material containing silver halide grains spectrally sensitized with a non-desorptive sensitizing dye, silver halide grains not spectrally sensitized, and a hydrazine derivative is described in the claim of British Patent Publication (Laid-Open) 9,407,599. The light-sensitive grains spectrally sensitized and the light-insensitive grains not spectrally sensitized contribute to silver images formed, by imagewise exposure and development, because of the presence of the hydrazine derivative. However, this photographic material has the disadvantage that, when a developing solution is fatigued or the replenishment rate is low, the development of the light-insensitive grains by the presence of the hydrazine derivative becomes difficult to take place, resulting in reduced density of the silver images, and is not sufficient from the viewpoint of processing stability in running.

The system for forming ultrahigh-contrast images using hydrazine derivatives is a system using dihydroxybenzene compounds such as hydroquinone as developing agents, as described above, and have some disadvantages from the ecological and toxicological viewpoints. For example, hydroquinone is an unfavorable component because of its allergy inducing effect. In this image formation system, amines as described in U.S. Pat. No. 4,975,354 are used simultaneously, and they are unfavorable in terms of toxicity and volatility.

SUMMARY OF THE INVENTION

It is therefore an object of the present invention to provide a novel development processing method which makes it possible to obtain high-contrast images required in the field of graphic arts by using a developing solution having no problem with respect to the ecosystem and working environment.

Another object of the present invention is to provide a development processing method which has a reduced processing unevenness and an excellent running stability even when processing is conducted at a low replenishment rate.

Other objects and effects of the present invention will become apparent from the following description.

The above described objectives of the present invention have been achieved by providing a development processing method which comprises developing a silver halide photographic material with a developing solution, (i) wherein the silver halide photographic material comprises a support having thereon at least one light-sensitive silver halide emulsion layer and contains:
  (a) at least two kinds of light-sensitive silver halide emulsions which are each spectrally sensitized and have sensitivities different from each other with respect to a certain exposure wavelength; and
  (b) at least one hydrazine derivative in at least one layer of the silver halide emulsion layer and other hydrophilic colloidal layers, and (ii) wherein the developing solution is substantially free from a dihydroxybenzene compound, has a pH of from 9.0 to 10.5 and contains:
  (1) at least one ascorbic acid developing agent and (2) at least one auxiliary developing agent represented by the following general formula (I):

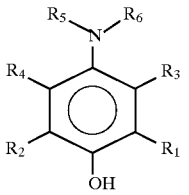

(I)

wherein $R_1$, $R_2$, $R_3$ and $R_4$, which may be the same or different, each represents a hydrogen atom or a substituent group; and $R_5$ and $R_6$, which may be the same or different, each represents an alkyl group, an aryl group, an aralkyl group or a heterocyclic group.

The at least two kinds of light-sensitive silver halide emulsions may be contained in a single silver halide emulsion layer. Alternatively, the at least two kinds of light-sensitive silver halide emulsions may be contained in separate silver halide emulsion layers.

In a preferred embodiment, the hydrazine derivative is represented by the following general formula (NB):

$$A\text{-}(B)_m \qquad \text{(NB)}$$

wherein A represents a connecting group, m represents an integer of 2 to 6, and B represents a group represented by the following general formula (B-1):

$$\text{-}(L_2\text{—}Ar_2)_n\text{-}L_1\text{—}Ar_1\text{—}NHNH\text{—}G_1\text{—}R_1 \qquad \text{(B-1)}$$

wherein $Ar_1$ and $Ar_2$ each represents an aromatic group or an aromatic heterocyclic group; $L_1$ and $L_2$ each represents a connecting group; n represents 0 or 1; $R_1$ represents a hydrogen atom, an alkyl group, an aryl group, a heterocyclic group, an alkoxyl group, an aryloxy group, an amino group or a hydrazino group; $G_1$ represents —CO—, —$SO_2$—, —SO—, —P($R_2$)(=O)—, —CO—CO—, a thiocarbonyl group or an iminomethylene group; and $R_2$ is selected from those defined for $R_1$ and may be different from $R_1$.

In another preferred embodiment, the development is conducted while replenishing the development solution at a replenishment rate of 180 ml or less per 1 $m^2$ of the silver halide photographic material.

In a further other preferred embodiment, the pH of the developing solution is from 9.0 to 10.0.

DETAILED DESCRIPTION OF THE INVENTION

The developing solution for use in the present invention is described in detail below.

The developing solution for processing photographic materials for use in the present invention can contain additives usually employed (for example, developing agents, alkali agents, pH buffers, preservatives or chelating agents). In the processing of the present invention, any of the known methods can be used, and the developing solutions known in the art can be used.

The developing agents contained in the developing solution for use in the present invention are ascorbic acid derivatives, and the developing solution contain substantially no dihydroxybenzene developing agents. The term substantially no" used herein means the concentration of dihydroxybenzene developing agent in the developing solution is 0.1 g/liter or less.

Preferred ascorbic acid derivative developing agents for use in the present invention are compounds represented by general formula (II):

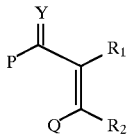

(II)

wherein $R_1$ and $R_2$ each represents a hydroxyl group, an amino group (including a group having an alkyl group of 1 to 10 carbon atoms such as methyl, ethyl, n-butyl or hydroxyethyl, as a substituent group), an acylamino group (such as acetylamino or benzoylamino), an alkylsulfonylamino group (such as methanesulfonylamino), an arylsulfonylamino group (benzenesulfonylamino or p-toluenesulfonylamino), an alkoxycarbonylamino group (methoxycarbonylamino), a mercapto group or an alkylthio group (such as methylthio or ethylthio). Preferred examples of $R_1$ and $R_2$ include hydroxyl, amino, alkylsulfonylamino and arylsulfonylamino groups.

P and Q each represents a hydroxyl group, a hydroxyalkyl group, a carboxyl group, a carboxyalkyl group, a sulfo group, a sulfoalkyl group, an amino group, an aminoalkyl group, an alkyl group, an alkoxyl group or a mercapto group, or an atomic group necessary for forming a 5-, 6- or 7-membered ring together with the two vinyl carbon atoms on which $R_1$ and $R_2$ are substituted and the carbon atom on which Y is substituted. Specific examples of such ring structures include combinations of —O—, —C($R_4$)($R_5$)—, —C($R_6$)=, —C(=O)—, —N($R_7$)— and —N=, wherein $R_4$, $R_5$, $R_6$ and $R_7$ each represents a hydrogen atom, an alkyl group having 1 to 10 carbon atoms which may be substituted (substituent groups include hydroxyl, carboxyl and sulfo groups), a hydroxyl group or a carboxyl group. Further, saturated or unsaturated condensed rings may be formed on the 5- to 7-membered rings.

Examples of the 5- to 7-membered rings include dihydrofuranone, dihydropyrone, pyranone, cyclopentenone, cyclohexenone, pyrrolinone, pyrazolinone, pyridone, azacyclohexenone and uracil rings. Preferred examples thereof include dihydrofuranone, cyclopentenone, cyclohexenone, pyrazolinone, azacyclohexenone and uracil rings.

Y is a group composed of ═O or ═N—$R_3$, wherein $R_3$ represents a hydrogen atom, a hydroxyl group, an alkyl group (for example, methyl or ethyl), an acyl group (for example, acetyl), a hydroxyalkyl group (for example, hydroxymethyl or hydroxyethyl), a sulfoalkyl group (for example, sulfomethyl or sulfoethyl) or a carboxyalkyl group (for example, carboxymethyl or carboxyethyl).

Specific examples of the compounds represented by general formula (II) are enumerated below, but the present invention is not limited thereto.

II-1

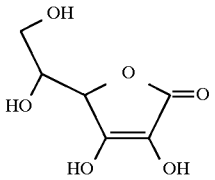

II-2

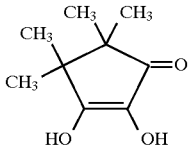

II-3

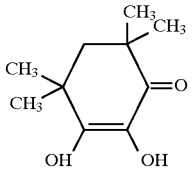

II-4

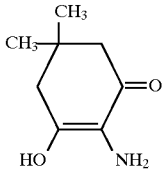

II-5

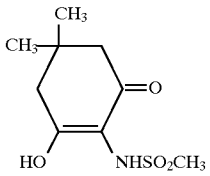

II-6

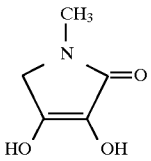

II-7

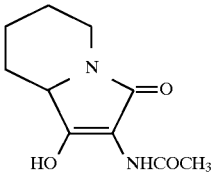

-continued

II-8

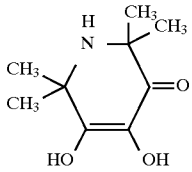

II-9

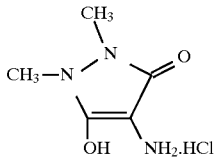

II-10

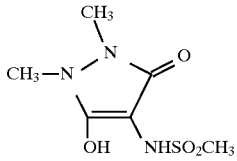

II-11

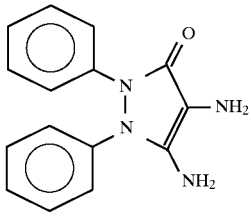

II-12

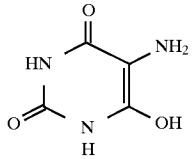

II-13

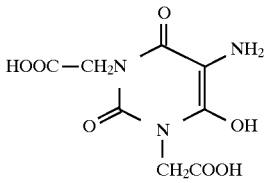

II-14

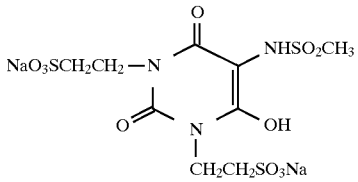

II-15

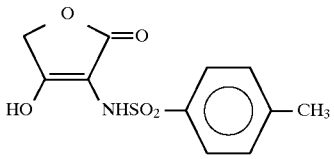

II-16

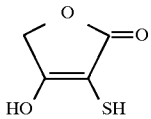

-continued

II-17

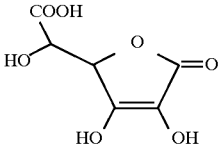

II-18

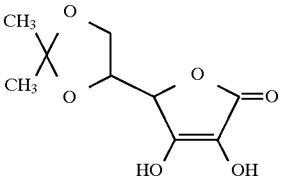

II-19

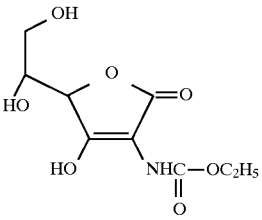

II-20

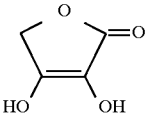

II-21

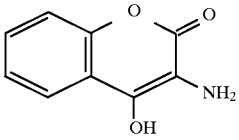

II-22

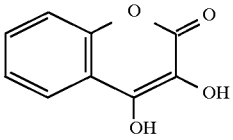

II-23

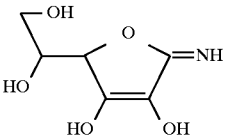

II-24

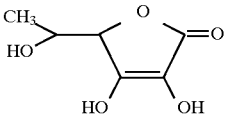

II-25

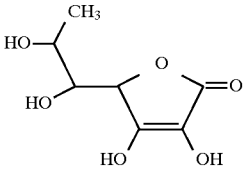

II-26

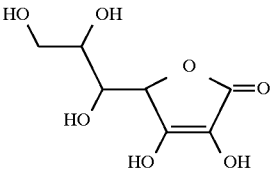

-continued

II-27

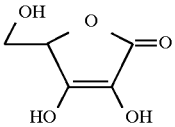

II-28

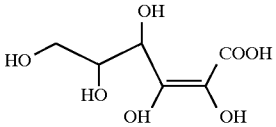

II-29

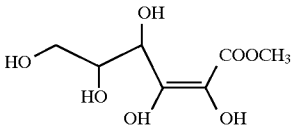

II-30

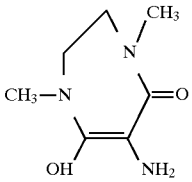

II-31

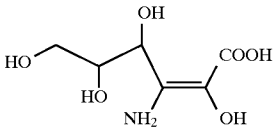

Of these, ascorbic acid and erythorbic acid (a diastereomer of ascorbic acid) are preferred.

As the ascorbic acid derivatives for use in the developing solution in the present invention, the endiol type, enaminol type, the endiamin type, the thiol-enol type and the enaminthiol type are-generally known. Examples of these compounds are described in U.S. Pat. No. 2,688,549 and JP-A-62-237443. Synthesis methods of these ascorbic acid derivatives are also well known, and are described, for example, in Tsugio Nomura and Hirohisa Ohmura, *Chemistry of Reductons*, Uchida Rohkakuho Shinsha (1969). The ascorbic acid derivatives used in the present invention can also be used in the form of alkali metal salts such as lithium salts, sodium salts and potassium salts.

The compounds represented by general formula (II) are used generally in an amount of $5\times10^{-3}$ to 1 mol, and preferably in an amount of $10^{-2}$ to 0.5 mol, per liter of the developing solution.

The ascorbic acid derivative developing agent is preferably used in an amount of 0.05 mol/liter to 1.0 mol/liter, and more preferably in an amount of 0.1 mol/liter to 0.5 mol/liter. When the ascorbic acid derivative is used in combination with a 1-phenyl-3-pyrazolidone compound or a p-aminophenol, it is preferred to use the former in an amount of 0.05 mol/liter to 1.0 mol/liter, more preferably in an amount of 0.1 mol/liter to 0.5 mol/liter, and the latter in an amount of 0.2 mol/liter or less, more preferably in an amount of 0.1 mol/liter or less.

Preservatives for use in the present invention include sodium sulfite, potassium sulfite, lithium sulfite, ammonium sulfite, sodium bisulfite, potassium metabisulfite and sodium formaldehydebisulfite. The sulfites are preferably added in an amount of 0.3 mol/liter or less, and more preferably in an amount of 0.1 mol/liter or less, because the addition of large amounts of sulfites causes silver stain in the developing solutions.

Besides, other additives for use in the present invention include development inhibitors such as sodium bromide and potassium bromide; organic solvents such as ethylene glycol, diethylene glycol, triethylene glycol and dimethylformamide; development accelerators such as alkanolamines such as diethanolamine and triethanolamine, and imidazole or derivatives thereof; and antifoggants or black pepper inhibitors such as mercapto compounds, indazole compounds, benzotriazole compounds and benzoimidazole compounds, specific examples of which include 5-nitroindazole, 5-p-nitrobenzoylaminoindazole, 1-methyl-5-nitroindazole, 6-nitroindazole, 3-methyl-5-nitroindazole, 5-nitrobenzimidazole, 2-isopropyl-5-nitrobenzimidazole, 5-nitrobenzotriazole, sodium 4-[(2-mercapto-1,3,4-thiadiazole-2-yl)thio]butanesulfonate, 5-amino-1,3,4-thiadiazole-2-thiol, methylbenzotriazole, 5-methylbenzotriazole and 2-mercaptobenzotriazole. The amount of these antifoggants is usually 0.01 to 10 mmol, and more preferably 0.1 to 2 mmol, per liter of developing solution.

Further, in the developing solution for use in the present invention, various kinds of organic and inorganic chelating agents can be used alone or in combination. Sodium tetrapolyphosphate and sodium hexametaphosphate can be used as the inorganic chelating agents.

On the other hand, organic carboxylic acids, aminopolycarboxylic acids, organic sulfonic acids, aminosulfonic acids and organic phosphonocarboxylic acids can be mainly used as the organic chelating agents.

The organic carboxylic acids include acrylic acid, oxalic acid, malonic acid, succinic acid, glutaric acid, adipic acid, pimelic acid, azelaic acid, sebacic acid, nonane dicarboxylic acid, decane dicarboxylic acid, undecanedicarboxylic acid, maleic acid, itaconic acid, malic acid, citric acid and tartaric acid.

The aminopolycarboxylic acids include iminodiacetic acid, nitrilotriacetic acid, nitrilotripropionic acid, ethylenediamine monohydroxyethyltriacetic acid, ethylenediamine tetraacetic acid, glycol ether tetraacetic acid, 1,2-diaminopropane tetraacetic acid, diethylenetriaminepentaacetic acid, triethylenetetraminehexaacetic acid, 1,3-diamino-2-propanoltetraacetic acid, glycoletherdiaminetetraacetic acid and compounds described in JP-A-52-25632, JP-A-55-67747, JP-A-57-102624 and JP-B-53-40900.

The organic phosphonic acids include hydroxyalkylidene diphosphonic acids described in U.S. Pat. Nos. 3,214,454 and 3,794,591 and West German Patent (OLS) 2,227,396, and compounds described in *Research Disclosure,* 181, Item 18170 (May, 1979).

The aminophosphonic acids include compounds described in *Research Disclosure,* 18170 described above, JP-A-57-208554, JP-A-54-61125, JP-A-55-29883 and JP-A-56-97347, as well as aminotris(methylenephosphonic acid), ethylenediaminetetramethylene phosphonic acid and aminotrimethylenephosphonic acid.

The organic phosphonocarboxylic acids include compounds described in JP-A-52-102726, JP-A-53-42730, JP-A-54-121127, JP-A-55-4024, JP-A-55-4025, JP-A-55-126241, JP-A-55-65955, JP-A-55-65956 and *Research Disclosure,* 18170 described above.

These chelating agents may be used in the form of alkali metal salts or ammonium salts. The amount of these chelating agents added is preferably $1\times10^{-4}$ to $1\times10^{-1}$ mol, and more preferably $1\times10^{-3}$ to $1\times10^{-2}$ mol, per liter of developing solution.

Further, compounds described in JP-A-56-24347, JP-B-56-45685, JP-B-62-2849 and JP-A-4-362942 can be used in the developing solutions as silver stain inhibitors.

Furthermore, compounds described in JP-A-62-212651 can be used as developer streak inhibitors, and compounds described in JP-A-61-267759 can be used as auxiliary solvents.

The developing solutions may further contain color toning agents, surfactants, antifoaming agents and hardening agents as needed.

The processing temperature and processing time are related to each other, and determined with reference to the whole processing time. The processing temperature is generally about 20° C. to about 50° C., and preferably 25° C. to 45° C., and the processing time is 5 seconds to 2 minutes, and preferably 7 seconds to 1 minute and 30 seconds.

In the present invention, it is preferred that a developing start solution and a developing replenisher each has the property that "when 0.1 mol of acetic acid is added to 1 liter of the solution, a decrease in pH is 0.3 or less". In a method for confirming that the developing start solution or the developing replenisher to be used has this property, the pH of the developing start solution or the developing replenisher to be tested is adjusted to 10.0, then, 0.1 mol of acetic acid is added to 1 liter of the solution, and the pH value of the solution at this time is measured. When a decrease in pH value is 0.3 or less, the solution is judged to have the property defined above. In the present invention, the developing start solution and the developing replenisher each having a decrease in pH value of 0.25 or less in the above-mentioned test are preferably used.

As a method for imparting the above-mentioned property to the developing start solution and the developing replenisher, the use of buffers is preferred. The buffers used herein include carbonates, boric acid described in JP-A-62-186259, saccharides (for example, saccharose) described in JP-A-60-93433, oximes (for example, acetoxime), phenols (for example, 5-sulfosalicylic acid) and tertiary phosphates (for example, sodium salts and potassium salts), and the carbonates and boric acid are preferably used. The buffers, particularly the carbonates, are used preferably in an amount of 0.3 mol/liter or more, and more preferably in an amount of 0.5 to 1.5 mol/liter.

In the present invention, the pH of the developing start solution is from 9.0 to 10.5, and preferably from 9.5 to 10.0. The pH of the developing replenisher and that of the developing solution in a developing tank in continuous processing is also within this range.

As alkali agents for use in pH adjustment, ordinary water-soluble inorganic alkali metal salts (for example, sodium hydroxide, potassium hydroxide, sodium carbonate and potassium carbonate) can be used.

When 1 $m^2$ of a silver halide photographic material is processed, the replenishment rate of the developing solution is generally 350 ml or less, preferably 180 ml or less, more preferably from 30 ml to 180 ml, and particularly preferably from 50 ml to 100 ml.

The developing replenisher may have the same composition as that of the developing start solution, or may have a higher concentration than the start solution for components consumed in development. In the present invention, the pH of the developing solution decreases as the processing of the photographic material proceeds. It is therefore preferred that the pH of the developing replenisher is adjusted to a value higher than that of the developing start solution. Specifically, the pH of the developing replenisher is adjusted preferably 0.05 to 1.0 higher, more preferably 0.3 to 0.7 higher than that of the developing start solution.

For reducing transport costs of processing solutions, packaging material costs and space, it is preferred that the processing solutions are concentrated, and diluted at the time of use.

Compounds represented by general formula (I) are described in detail.

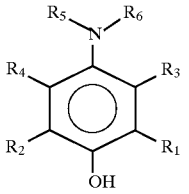

(I)

wherein $R_1$, $R_2$, $R_3$ and $R_4$, which may be the same or different, each represents a hydrogen atom or a substituent group. $R_5$ and $R_6$, which may be the same or different, each represents an alkyl group, an aryl group, aralkyl group or a heterocyclic group.

p-Aminophenols represented by general formula (I) are described in detail.

In general formula (I), $R_1$, $R_2$, $R_3$ and $R_4$, which may be the same or different, each represents a hydrogen atom or a substituent group. Examples of the substituent groups include alkyl, aryl, aralkyl, heterocyclic, halogen atoms, cyano, nitro, mercapto, hydroxyl, alkoxyl, aryloxy, alkylthio, arylthio, acyloxy, amino, alkylamino, carbonamido, sulfonamido, sulfamoylamino, ureido, acyl, oxycarbonyl carbamoyl, sulfonyl, sulfinyl, sulfamoyl, carboxyl (including salts thereof) and sulfo (including salts thereof). These groups may be substituted by substituent a group such as alkyl, alkenyl, alkynyl, aryl, halogen atoms, cyano, nitro, hydroxyl, alkoxyl, aryloxy, alkylthio, amino, alkylamino, ammonio, carbonamido, sulfonamido, sulfamoylamino, ureido, carbamoyl, sulfamoyl, carboxyl (including salts thereof) and sulfo (including salts thereof), or other substituent groups comprising an oxygen atom, a nitrogen atom, a sulfur atom or a carbon atom.

Examples of the substituent groups represented by $R_1$, $R_2$, $R_3$ and $R_4$ are described in more detail. The alkyl groups are straight-chain, branched-chain or cyclic alkyl groups each having 1 to 10 carbon atoms, and examples thereof include methyl, ethyl, propyl, isopropyl, t-butyl, cyclopentyl, cyclohexyl, benzyl, hydroxymethyl, 2-hydroxyethyl, 3-hydroxypropyl, 2,3-dihydroxypropyl and 2-methoxyethyl.

The aryl group is one having 6 to 10 carbon atoms, and examples thereof include phenyl, naphthyl and p-methoxyphenyl. The aralkyl group is one having 7 to 10 carbon atoms, and examples thereof include benzyl. The heterocyclic group is a 5- or 6-membered saturated or unsaturated heterocyclic group comprising a carbon atom, nitrogen atom, an oxygen atom or a sulfur atom. The ring may containes one or more kinds of heteroatoms. Examples of the heterocyclic groups include 2-furyl, 2-pyrrolyl, 2-imidazolyl, 1-pyrazolyl, 2-pyridyl, 2-pyrimidyl and 2-thienyl. The halogen atom is, for example, a fluorine or chlorine atom. The alkoxyl group is one having 1 to 10 carbon atoms, preferably 1 to 6 carbon atoms, and examples thereof include methoxy, ethoxy, propoxy, isopropoxy, 2-hydroxyethoxy, 3-hydroxypropoxy, 2-methoxyethoxy, hydroxyethoxyethoxy, 2,3-dihydroxypropoxy, 2-hydroxypropoxy and 2-methanesulfonylethoxy. The aryloxy group is one having 6 to 10 carbon atoms, and examples thereof include phenoxy, p-carboxyphenoxy and o-sulfophenoxy. The alkylthio group is one having 1 to 10 carbon atoms, preferably 1 to 6 carbon atoms, and examples thereof include methylthio and ethylthio. The arylthio group is one having 6 to 10 carbon atoms, and examples thereof include phenylthio and 4-methoxyphenylthio. The acyloxy group is one having 1 to 10 carbon atoms, preferably 1 to 6 carbon atoms, and examples thereof include acetoxy and propanoyloxy.

The alkylamino group is one having 1 to 10 carbon atoms, preferably 1 to 6 carbon atoms, and examples thereof include methylamino, diethylamino and 2-hydroxyethylamino. The carbonamido group is one having 1 to 10 carbon atoms, preferably 1 to 6 carbon atoms, and examples thereof include acetamido and propionamido. The sulfonamido group is one having 1 to 10 carbon atoms, preferably 1 to 6 carbon atoms, and examples thereof include methanesulfonamido. The sulfamoylamino group is one having 0 to 10 carbon atoms, preferably 0 to 6 carbon atoms, and examples thereof include methylsulfamoylamino and dimethylsulfamoylamino. The ureido group is one having 1 to 10 carbon atoms, preferably 1 to 6 carbon atoms, and examples thereof include ureido, methylureido, N,N-dimethylureido. The acyl group is one having 1 to 10 carbon atoms, preferably 1 to 6 carbon atoms, and examples thereof include acetyl and benzoyl. The oxycarbonyl group is one having 1 to 10 carbon atoms, preferably 1 to 6 carbon atoms, and examples thereof include methoxycarbonyl and ethoxycarbonyl. The carbamoyl group is one having 1 to 10 carbon atoms, preferably 1 to 6 carbon atoms, and examples thereof include carbamoyl, N,N-dimethylcarbamoyl and N-ethylcarbamoyl. The sulfonyl group is one having 1 to 10 carbon atoms, preferably 1 to 6 carbon atoms, and examples thereof include methanesulfonyl and ethanesulfonyl. The sulfinyl group is one having 1 to 10 carbon atoms, preferably 1 to 6 carbon atoms, and examples thereof include methanesulfinyl. The sulfamoyl group is one having 0 to 10 carbon atoms, preferably 0 to 6 carbon atoms, and examples thereof include sulfamoyl and dimethylsulfamoyl.

$R_5$ and $R_6$, which may be the same or different, each represents an alkyl group, an aryl group, aralkyl group or a heterocyclic group. They have the same meaning as that given for $R_1$, $R_2$, $R_3$ and $R_4$. However, when $R_5$ and $R_6$ are alkyl groups, they may combine with each other to form a 5- or 6-membered ring together with the nitrogen atom in general formula (I). In this case, such rings include, for example, pyrrolidine, piperidine, piperazine and morpholine rings. Further, when at least one of $R_5$ and $R_6$ is an alkyl group and at least one of $R_3$ and $R_4$ is an alkyl group or an alkoxyl group, they may combine with each other to form a condensed heterocycle together with a nitrogen atom and a benzene ring. The 5- and 6-membered rings formed by condensation with benzene rings include, for example, indole, indoline, dihydroquinoline, tetrahydroquinoline and benzoxazine.

The compound represented by general formula (I) may be a dimer to form a bis-type structure.

In the present invention, the concentration of the compound of general formula (I) in the developing solution is generally from 0.2 mol/liter or less, preferably 0.1 mol/liter or less.

Of the compounds represented by general formula (I), compounds represented by the following general formula (A) are preferred.

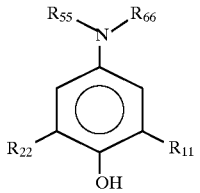

(A)

wherein $R_{11}$ and $R_{22}$, which may be the same or different, each represents a hydrogen atom or a substituent group; and $R_{55}$ and $R_{66}$, which may be the same or different, each represents an alkyl group, an aryl group, an aralkyl group or a heterocyclic group.

With respect to $R_{11}$ and $R_{22}$, and $R_{55}$ and $R_{66}$ in general formula (A), preferred combinations thereof are described below.

Preferred combinations are those where $R_{11}$ and $R_{22}$ are each hydrogen, alkyl, hydroxyl, alkoxyl, amino, alkylamino, carbonamido, sulfonamido, sulfamoylamino or ureido, and $R_{55}$ and $R_{66}$ are each alkyl, in which the alkyl, alkoxyl and alkylamino may be substituted by another substituent group.

In these combinations, it is more preferred that $R_{55}$ and $R_{66}$ are each an unsubstituted alkyl group or an alkyl group substituted by a water-soluble group. The water-soluble group includes hydroxyl, alkoxyl, amino, alkylamino, ammonio, carbonamido, sulfonamido, sulfamoylamino, ureido, carbamoyl, sulfamoyl, carboxyl (including salts thereof) and sulfo (including salts thereof).

More preferred compounds represented by general formula (A) are those where $R_{11}$ is hydrogen, $R_{22}$ is alkyl, alkoxyl, carbonamido, sulfonamido, sulfamoylamino or ureido, and $R_{55}$ and $R_{66}$ are each alkyl, wherein the alkyl, alkoxyl, carbonamido, sulfonamido, sulfamoylamino and ureido include those substituted by hydroxyl, alkoxyl, amino, alkylamino, ammonio, carbonamido, sulfonamido, sulfamoylamino or ureido.

Still more preferred compounds represented by general formula (A) are those where $R_{11}$ is hydrogen, $R_{22}$ is alkyl having 1 to 3 carbon atoms, alkoxyl having 1 to 4 carbon atoms, carbonamido having 1 to 3 carbon atoms, sulfonamido having 1 to 3 carbon atoms, sulfamoylamino having 1 to 3 carbon atoms, or ureido having 1 to 3 carbon atoms, and $R_{55}$ and $R_{66}$ are each unsubstituted alkyl having 1 to 3 carbon atoms, wherein the alkyl and alkoxyl represented by $R_{22}$ include those substituted by hydroxyl, alkoxyl, carbonamido or sulfonamido.

Most preferred compounds represented by general formula (A) are those where $R_{11}$ is hydrogen, $R_{22}$ is alkyl having 1 to 3 carbon atoms, alkoxyl having 1 to 4 carbon atoms, carbonamido having 1 to 3 carbon atoms, sulfonamido having 1 to 3 carbon atoms, or ureido having 1 to 3 carbon atoms, and $R_{55}$ and $R_{66}$ are each methyl having 1 to 3 carbon atoms, wherein the alkyl and alkoxyl represented by $R_{22}$ include those substituted by hydroxyl or alkoxyl.

Specific examples of the compounds for use in the present invention include, but are not limited to, the compounds as shown below.

The compounds represented by general formula (A) are sometimes unstable as free aniline. It is therefore preferred that they are produced and stored as salts with inorganic or organic acids, and converted to free aniline upon addition thereof to processing solutions. The inorganic or organic acids forming salts with the compounds represented by general formula (A) include, for example, hydrochloric acid, hydrobromic acid, sulfuric acid, p-toluenesulfonic acid, methanesulfonic acid and naphthalene-1,5-disulfonic acid. In particular, it is preferable to form salts of sulfuric acid or naphthalene-1,5-disulfonic acid.

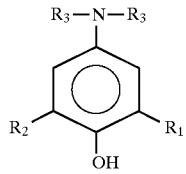

| No. | $R_1$ | $R_2$ | $R_3$ |
|---|---|---|---|
| A-1 | $-H$ | $-H$ | $-CH_3$ |
| A-2 | $-OCH_3$ | $-H$ | $-CH_3$ |
| A-3 | $-OCH_3$ | $-OCH_3$ | $-CH_3$ |
| A-4 | $-NHCOCH_3$ | $-H$ | " |
| A-5 | $-NHCOCH_3$ | $-NHCOCH_3$ | " |
| A-6 | $-NHCONHCH_3$ | $-H$ | " |
| A-7 | $-NHCONH_2$ | $-H$ | " |
| A-8 | $-CH_2OH$ | $-CH_2OH$ | " |
| A-9 | $-NHSO_2CH_3$ | $-H$ | " |
| A-10 | $-OH$ | $-H$ | " |
| A-11 | $-NH_2$ | $-H$ | " |
| A-12 | $-NHSO_2NH_2$ | $-H$ | " |
| A-13 | $-NHCH_3$ | $-H$ | $-CH_3$ |
| A-14 | $-NHSO_2N(CH_3)_2$ | " | " |
| A-15 | $-CH_3$ | $-CH_3$ | " |
| A-16 | $-CH_2\overset{\oplus}{N}(CH_3)_3\ Cl^{\ominus}$ | $-H$ | " |
| A-17 | $-H$ | " | $-C_2H_5$ |
| A-18 | $-OCH_3$ | " | " |
| A-19 | $-NHCONH_2$ | " | " |
| A-20 | $-NHCSNH_2$ | " | $-CH_3$ |
| A-21 | $-OCH_2CH_2NHSO_2CH_3$ | " | " |
| A-22 | $-OCH_2CH_2OH$ | " | " |
| A-23 | $-OCH_2CH_2OCH_3$ | " | " |
| A-24 | $-OCH_2CH_2CH_2OH$ | " | " |

-continued

| | | | |
|---|---|---|---|
| A-25 | $-OCH_2CH_2CH_2OCH_3$ | $-H$ | $-CH_3$ |
| A-26 | $-OCH_2CH(OH)CH_2OH$ | " | " |
| A-27 | $-OCH_2CH_2OCH_2CH_2OH$ | " | " |
| A-28 | $-OCH_2CH(CH_3)OH$ | " | " |
| A-29 | $-SC_2H_5$ | " | " |
| A-30 | $-SCH_2CH_2OH$ | " | " |
| A-31 | $-OCH(CH_3)_2$ | " | " |
| A-32 | $-Cl$ | " | " |
| A-33 | $-OC_2H_5$ | " | " |
| A-34 | $-OC_2H_4OCH_3$ | " | $-CH_2CH_2OCH_3$ |
| A-35 | $-NHCOCH_3$ | " | $-CH_2CH_2CH_2OH$ |
| A-36 | $-OC_2H_4OH$ | " | $-CH_2CH_2OH$ |

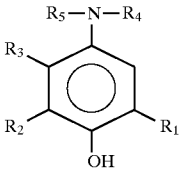

| No. | $R_1$ | $R_2$ | $R_3$ | $R_4$ | $R_5$ |
|---|---|---|---|---|---|
| A-37 | $-NHCOCH_3$ | $-H$ | $-H$ | $-CH_2CH_2CH_2OH$ | $-CH_2CH_2CH_2OH$ |
| A-38 | $-OCH_3$ | " | " | " | " |
| A-39 | " | $-OCH_3$ | " | " | " |
| A-40 | $-H$ | $-H$ | " | " | " |
| A-41 | " | " | $-CH_3$ | " | " |
| A-42 | $-OC_3H_6OH$ | " | $-H$ | $-CH_3$ | $-CH_2CH_2CH_2OH$ |
| A-43 | $-OCH_3$ | " | " | " | " |
| A-44 | $-NHCOCH_3$ | " | " | " | " |
| A-45 | $-NHCONH_2$ | " | " | " | $-CH_2CH_2CH_2CH_2OH$ |
| A-46 | $-NHSO_2CH_3$ | " | " | " | " |
| A-47 | $-OC_2H_4OCH_3$ | " | " | " | " |
| A-48 | $-O-CH(CH_3)_2$ | " | " | $-CH_2CH_2CH_2CH_2OH$ | $-CH_2CH_2CH_2CH_2OH$ |

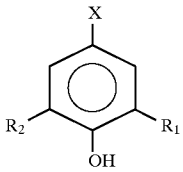

| No. | $R_1$ | $R_2$ | X |
|---|---|---|---|
| A-49 | $-H$ | $-H$ | 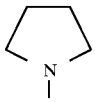 |
| A-50 | $-OCH_3$ | " | " |

-continued
| | | | |
|---|---|---|---|
| A-51 | $-OCH_3$ | $-OCH_3$ | 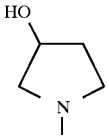 |
| A-52 | $-NHCONHCH_3$ | $-H$ | 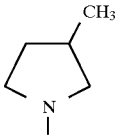 |
| A-53 | $-OCH_2CH_2OCH_3$ | $-H$ | 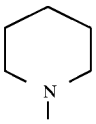 |
| A-54 | $-NHSO_2CH_3$ | $-H$ | 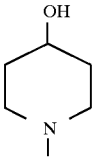 |
| A-55 | $-H$ | $-H$ | 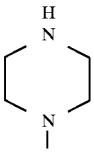 |
| A-56 | $-OCH_3$ | " | 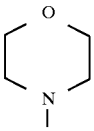 |
| A-57 | " | " | 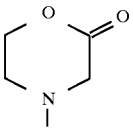 |
| A-58 | $-OC_3H_6OH$ | " | 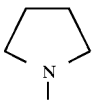 |
| A-59 | $-CH_2OH$ | $-CH_2OH$ | " |
| A-60 | $-H$ | $-H$ | 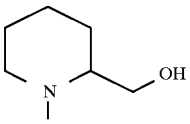 |
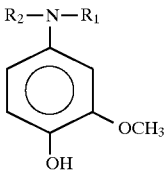

-continued
| No. | $R_1$ | $R_2$ |
|---|---|---|
| A-61 | $-CH_3$ | 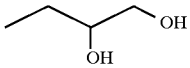 |
| A-62 | 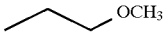 | 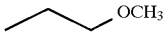 |
| A-63 | 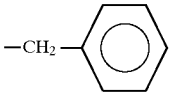 | 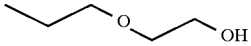 |
| A-64 | $-CH_3$ | 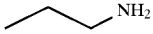 |
| A-65 | $-CH_3$ | 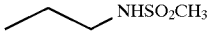 |
| A-66 | 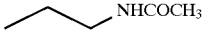 | 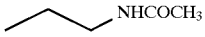 |
| | | 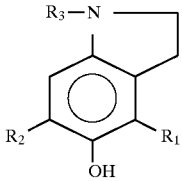 |
| No. | $R_1$ | $R_2$ | $R_3$ |
|---|---|---|---|
| A-67 | $-H$ | $-H$ | 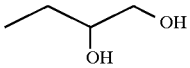 |
| A-68 | $-OCH_3$ | " | " |
| A-69 | $-NHCONH_2$ | " | " |
| A-70 | $-NHSO_2CH_3$ | " | 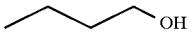 |
| A-71 | $-OCH_3$ | $-OCH_3$ | 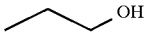 |
| | | 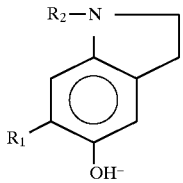 | |
| No. | $R_1$ | $R_2$ |
|---|---|---|
| A-72 | $-H$ | 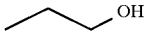 |
| A-73 | $-OCH_3$ | " |
| A-74 | $-H$ | 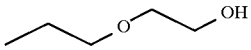 |
| A-75 | $-OCH_3$ | " |
| A-76 | $-H$ | 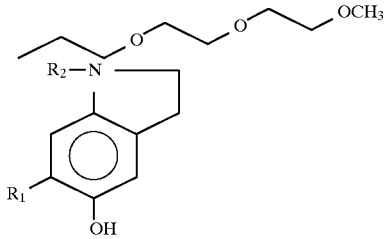 |

-continued
| No. | $R_1$ | $R_2$ |
|---|---|---|
| A-77 | $-H$ | 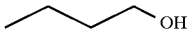 |
| A-78 | 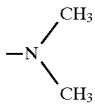 | " |
| A-79 | 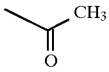 | " |
| A-80 | $-CO_2H$ | $-CH_3$ |
| A-81 | | 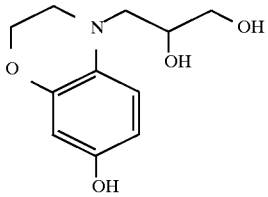 |
| A-82 | | 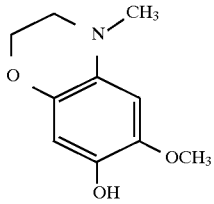 |
| A-83 | | 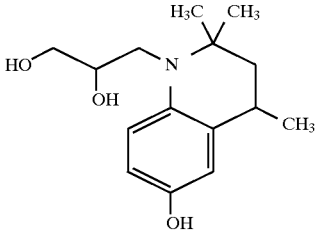 |
| A-84 | | 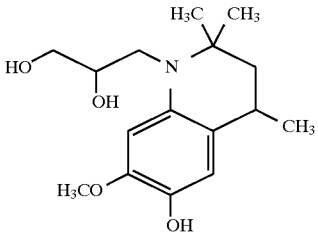 |
| A-85 | | 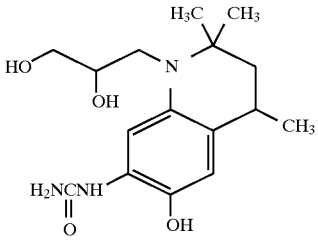 |

-continued
A-86
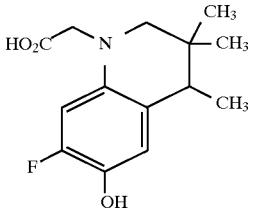
A-87
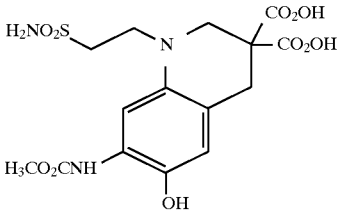
A-88
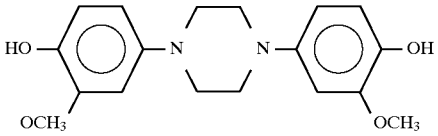
A-89
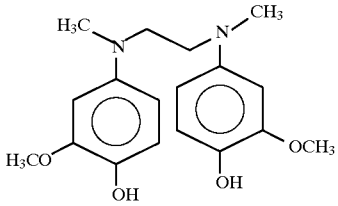
A-90
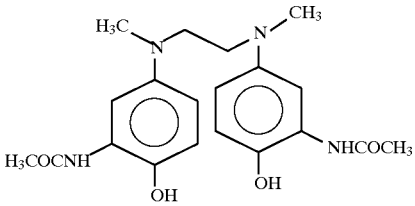
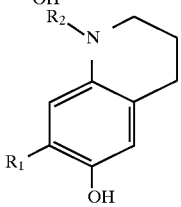
| No. | $R_1$ | $R_2$ |
|---|---|---|
| A-91 | $-OCH_3$ | $-CH_3$ |
| A-92 | $-H$ | 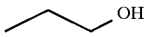 |
| A-93 | " | 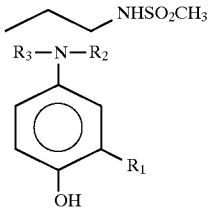 |

-continued

| No. | $R_1$ | $R_2$ | $R_3$ |
|---|---|---|---|
| A-94 | $-SH$ | 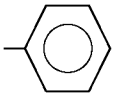 | 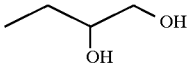 |
| A-95 | $-SCH_3$ | $-CH_3$ | $-C_3H_6-OH$ |
| A-96 | $-COOCH_3$ | 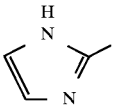 | " |
| A-97 | $-CONH_2$ | 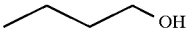 | " |
| A-98 | 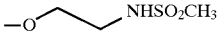 | $-CH_3$ | " |
| A-99 | $-CH_2OH$ | " | $-CH_3$ |
| A-100 | 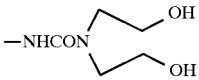 | " | " |
| A-101 | $-H$ | 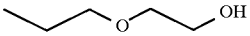 | 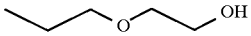 |
| A-102 | $-OCH_3$ | " | " |
| A-103 | $-COCH_3$ | $-CH_3$ | $-CH_3$ |
| A-104 | $-CONH_2$ | " | " |
| A-105 | 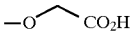 | " | " |

The compounds represented by general formula (A) can be easily synthesized based on the general synthesis methods described, for example, in *Photographic Science and Engineering,* 10, 306 (1966).

As fixing agents of a fixing processing agent for use in the present invention, ammonium thiosulfate, sodium thiosulfate and ammonium sodium thiosulfate can be used. The amount of the fixing agent used can be appropriately changed, but it is generally about 0.7 to about 3.0 mol/liter.

The fixing solution for use in the present invention may contain water-soluble aluminum salts or water-soluble chromium salts acting as hardening agents, and the water-soluble aluminum salts are preferred. Examples thereof include aluminum chloride, aluminum sulfate, potassium alum, ammonium aluminum sulfate, aluminum nitrate and aluminum lactate. It is preferred that these are contained in an amount of 0.01 to 0.15 mol/liter as the aluminum ion concentration in working solutions.

When the fixing solutions are preserved as concentrated solutions or solid agents, they may be composed of a plurality of parts, separating the hardeners and the like as other parts, or may be one-part type solutions containing all components.

The fixing solutions can contain preservatives (for example, 0.015 mol/liter or more, preferably 0.02 mol/liter to 0.3 mol/liter of sulfites, bisulfites or metabisulfites), pH buffers (for example, 0.1 mol/liter to 1 mol/liter, preferably 0.2 mol/liter to 0.7 mol/liter of acetic acid, sodium acetate, sodium carbonate, sodium hydrogencarbonate, phosphoric acid, succinic acid or adipic acid) and compounds having aluminum-stabilizing ability or water-softening ability (for example, 0.001 mol/liter to 0.5 mol/liter, preferably 0.005 mol/liter to 0.3 mol/liter of gluconic acid, iminodiacetic acid, 5-sulfosalicylic acid, glucoheptanoic acid, malic acid, tartaric acid, citric acid, oxalic acid, maleic acid, glycolic acid, benzoic acid, salicylic acid, Tiron, ascorbic acid, glutaric acid, aspartic acid, glycine, cysteine, ethylenediaminetetraacetic acid, nitrilotriacetic acid, derivatives or salts thereof, saccharides or boric acid), if desired.

In addition, the fixing solutions can contain compounds described in JP-A-62-78551, pH regulators (for example, sodium hydroxide, ammonium and sulfuric acid), surfactants, wetting agents and fixing accelerators. The surfactants include, for example, anionic surfactants such as sulfates and sulfonates, polyethylene surfactants and amphoteric surfactants described in JP-A-57-6840, and known antifoaming agents can also be used. The wetting agents include alkanolamines and alkylene glycols. The fixing accelerators include alkyl- and allyl-substituted thiosulfonic acids and salts thereof described in JP-A-6-308681, thiourea derivatives described in JP-B-45-35754, JP-B- 58-122535 and JP-B-58-122536, alcohols having triple bonds in their molecules, thioether compounds described in U.S. Pat. No. 4,126,459, mercapto compounds described in JP-A-64-4739, JP-A-1-4739, JP-A-1-159645 and JP-A-3-101728, mesoionic compounds described in JP-A-4-170539, and thiocyanates.

The fixing solution for use in the present invention has a pH of 4.0 or more, preferably 4.5 to 6.0. The fixing solutions are contaminated with the developing solution by processing to increase the pH. In this case, the pH is 6.0 or less and preferably 5.7 or less for hardening fixing solutions, and the pH is 7.0 or less and preferably 6.7 or less for non-hardening fixing solutions.

The replenishment rate of the fixing solution is 400 ml or less, preferably 320 ml or less, and more preferably 50 ml to 200 ml, per $m^2$ of photographic material. The replenisher may have the same composition and/or concentration as that of the start solution, or may have a composition and/or a concentration different therefrom.

The fixing solutions can be regenerated by known regeneration methods of fixing solutions such as electrolytic silver recovery, followed by the use of them. Regeneration devices include, for example, an FS 8000 device manufactured by Fuji Photo Film Co., Ltd.

Further, it is also preferred that an adsorption filter such as activated carbon is used to eliminate a dye and the like.

The photographic materials which have been developed and fixed are then subjected to washing or stabilization processing (unless otherwise specified, the term "washing" hereinafter include "stabilization processing", and a solution used therefor is referred to as "water" or "washing water"). Water used for washing may be tap water, ion-exchanged water, distilled water or stabilized water. The replenishment rate thereof is generally about 8 liters to about 17 liters per $m^2$ of photographic material, but washing can also be conducted at a replenishment rate of less than that. In particular, washing at a replenishment rate of 3 liters or less (including 0, namely pool washing) not only makes water-saving processing possible, but also can make piping for installation of an automatic processor unnecessary. When washing is carried out at a low replenishment rate, it is more preferred that washing tanks having squeeze rolls or cross-over rolls described in JP-A-63-18350 and JP-A-62-287252 are provided. In order to reduce environmental pollution load which raises a problem in washing with a small amount of water, and to prevent water scale, addition of various oxidizing agents (for example, ozone, hydrogen peroxide, sodium hypochlorite, active halogen, chlorine dioxide and sodium carbonate peroxyhydrate) and filtration through filters may be combined therewith.

As a method for decreasing the replenishment rate of washing water, a multi-stage countercurrent system (for example, two-stage or three-stage) has been known for long, and the replenishment rate of washing water is preferably 50 to 200 ml/$m^2$ of photographic material. This effect is also similarly obtained by an independent multi-stage system (a method for replenishing a fresh solution to multi-stage washing tanks, separately, without use of countercurrent replenishment.

Further, water scale preventing means may be applied to a washing stage in the present invention. As the water scale preventing means, known means can be used, and there is no particular limitation thereon. Examples thereof include methods of adding antifungal agents (so-called water scale inhibitors), methods of passing electric currents, methods of irradiating ultraviolet rays, infrared rays or far infrared rays, methods of applying electromagnetic fields, methods of treating with ultrasonic waves, methods of applying heat and methods of making tanks empty at the time of nonuse. These water scale preventing means may be applied according to the processing of the photographic materials, or at certain intervals, regardless of the conditions of use, or only for periods in which the processing is not conducted, for example, at night. Further, washing water previously subjected to the water scale prevention means may be replenished. It is also preferred for prevention of generation of resistant bacteria that different water scale preventing means are applied for every definite period.

There is no particular limitation on the antifungal agents, and known ones can be used. Examples thereof include chelating agents such as glutaraldehyde and aminopolycarboxylic acid, cationic surfactants and mercaptopyridine oxide (for example, 2-mercaptopyridine-N-oxide), as well as the above-mentioned oxidizing-agents. They may be used alone or in combination.

As the methods for passing electric currents, methods described in JP-A-3-224685, JP-A-3-224687, JP-A-4-16280 and JP-A-4-18980 can be used.

In addition, for preventing water bubble spots or transfer of stains, known water-soluble surfactants or antifoaming agents may be added. In order to prevent contamination caused by dyes eluted from the photographic materials, dye adsorbents described in JP-A-63-163456 may be added to washing systems.

An overflowed solution from the washing stage can also be partly or wholly mixed with a processing solution having fixing ability to use the mixed solution, as described in JP-A-60-235133. It is also preferred from the view point of natural environmental protection that the overflowed solution is drained after decreases in biological oxygen demand (BOD), chemical oxygen demand (COD) and iodine demand by biological treatments (for example, treatments with sulfur-oxidizing bacteria or activated sludge, or treatments with filters in which microorganisms are carried on porous carriers such as activated carbon and ceramics) or by oxidation treatments by electric current passing or with oxidizing agents, or that the concentration of silver contained in drainage is reduced by filtering out silver through filters using polymers having affinity for silver or by adding compounds forming slightly soluble silver complexes such as trimercaptotriazine to precipitate silver and filtering out the precipitates.

Further, the washing processing is followed by stabilization processing in some cases. As an example thereof, baths containing compounds described in JP-A-2-201357, JP-A-2-132435, JP-A-1-102553 and JP-A-46-44446 may be used as final baths for the photographic materials. Ammonium compounds, compounds of metals such as Bi and Al, fluorescent whitening agents, various chelating agents, membrane pH regulators, hardening agents, disinfectants, antifungal agents, alkanolamines or surfactants can also be added to these stabilizing baths if necessary.

Additives such as the antifungal agents added to the washing and stabilizing baths, and stabilizing agents can also be used as solid agents similarly with the above-mentioned developing and fixing processing agents.

Waste liquids of the developing solutions, the fixing solutions, washing water and the stabilizing solutions used in the present invention are preferably burned to dispose them. It is also possible to concentrate or solidify these waste liquids with a concentrating device as described in JP-B-7-83867 and U.S. Pat. No. 5,439,560, followed by disposition.

When the replenishment rate is reduced, it is preferred to prevent evaporation and air oxidation of the solution by decreasing the opening area of the processing tank. Roller transfer type automatic processors are described in U.S. Pat. Nos. 3,025,779 and 3,545,971, and briefly referred to as roller transfer type automatic processors in this specification. This automatic processor comprises the four stages of development, fixing, washing and drying. It is most preferred that the methods used in the present invention also follow these four stages, although not excluding another stage (for example, a stop stage). Further, a rinsing bath may be provided between development and fixing, and/or between fixing and washing.

In the present invention, the development processing is preferably conducted for 25 seconds to 160 seconds at dry to dry. The developing and fixing time is 40 seconds or less, and preferably 6 seconds to 35 seconds, and the temperature of each solution is preferably 25° C. to 50° C., and more preferably 30° C. to 40° C. The temperature and the time of washing are preferably 0° C. to 50° C. and 40 seconds or less, respectively. According to the present invention, the photographic materials which have been developed, fixed and washed may be squeezed to remove washing water, namely, they may be passed between squeeze rolls, followed by drying. The drying is carried out at about 40° C. to about 100° C., and the drying time can be appropriately varied according to the environmental conditions. Any of known drying methods can be used, and there is no particular limitation thereon. Examples thereof include hot air drying, heat roller drying described in JP-A-4-15534, JP-A-5-2256 and JP-A-5-289294, and drying by far infrared rays, and the plural methods may be used in combination.

When the developing processing agents and the fixing processing agents used in the present invention are liquid agents, they are preferably stored in wrapping up in packaging materials having a low oxygen permeability as described, for example, in JP-A-61-73147. Further, when these solutions are concentrated solutions, they are diluted with water to give a specified concentration at the time of use, for example, at a rate of 0.2 to 3 parts of water per part of concentrated solution.

When the developing processing agents and the fixing processing agents for use in the present invention are in solid forms, these processing agents provide results similar to those obtained in liquid forms. The solid processing agents are described below.

The solid processing agents for use in the present invention can be employed in known forms (such as powdery, granular, massive, tablet, compactor, briquette, tabular, rod-like and paste-like forms). In order to separate components reacting with each other in contact, the components may be coated with water-soluble coating agents or films, or may be formed in plural-layer constitution to separate the components reacting with each other, or these may be used in combination.

Known compounds can be used as coating agents and granulating auxiliaries., and polyvinylpyrrolidone, polyethylene glycol, polystyrenesulfonic acid and vinyl compounds are preferred. In addition, reference can be made to JP-A-5-45805, column 2, line 48 to column 3, line 13.

In the case of the multiple layer constitution, a component which does not react even in contact may be put between components which react with each other to form a multiple-layered product, which may be processed to tablets or briquettes, or components of known forms may be formed to similar layer constitution, which may be wrapped. These methods are described, for example, in JP-A-61-259921, JP-A-4-16841, JP-A-4-78848 and JP-A-5-93991.

The bulk density of the solid processing agent is preferably 0.5 to 6.0 g/cm$^3$. In particular, it is preferably 1.0 to 5.0 g/cm$^3$ for the tablets, and 0.5 to 1.5 g/cm$^3$ for the granules.

As methods for producing the solid processing agents in the present invention, any of known methods can be used. For example, reference can be made to JP-A-61-259921, JP-A-4-15641, JP-A-4-16841, JP-A-4-32837, JP-A-4-78848, JP-A-5- 93991, JP-A-4-85533, JP-A-4-85534, JP-A-4-85535, JP-A-5-134362, JP-A-5-197070, JP-A-5-204098, JP-A-5-224361, JP-A-6-138604, JP-A-6-138605 and JP-A-8-286329.

More specifically, rolling granulation, extrusion granulation, compression granulation, pulverization granulation, stirring granulation, spray drying, dissolution coagulation, briquetting and roller compacting can be used.

The solid processing agents for use in the present invention can also be controlled in solubility by changing the surface conditions (such as smoothness and porousness), partially changing the thickness, or forming them into the hollow doughnut shape. Further, in order to give different solubilities to a plurality of granulated products or to match the solubility of materials different in solubility, it is also possible to take a plurality of forms. A multilayer granulated product may also be used in which a surface thereof is different from the inside thereof in composition.

As the packaging materials for the solid processing agents, materials low in oxygen permeability and moisture permeability are preferred, and known forms such as bag-like, cylindrical and box-like forms can be used for the packaging materials. Collapsible forms as disclosed in JP-A-6-242585 to JP-A-6-242588, JP-A-6-247432, JP-A-6-247448, JP-A-6-301189, JP-A-7-5664 and JP-A-7-5666 to JP-A-7-5669 are also preferred to decrease the space for storing waste packaging materials. These packaging materials may be provided with screw caps, pull tops or aluminum seals at outlets for the processing agents, or heat sealed. However, other known means may be used, without limitation thereto. Furthermore, it is preferable in respect to environmental protection to recycle or reuse the waste packaging materials.

There is no particular limitation on methods for dissolving and replenishing the solid processing agents used in the present invention, and known methods can be used. Examples of these methods include a method of dissolving a specified amount of the solid processing agent in a dissolving device having a stirring function and replenishing the resulting solution; a method of dissolving the solid processing agent in a dissolving device having a dissolving section and a section for stocking a completed solution, and replenishing the solution from the stocking section as described in JP-A-9-80718; a method of supplying the solid processing agent to a circulating system of an automatic processor, dissolving it, and replenishing the resulting solution as described in JP-A-5-119454, JP-A-6-19102 and JP-A-7-261357; and a method of supplying the processing agent into an automatic processor containing a dissolving tank according to the processing of a photographic material, and dissolving it. However, any of other known methods can also be used. The package may be either manually opened to supply the processing agent, or automatically opened to automatically supply the processing agent with a dissolving device or an automatic processor having an opening mechanism as described in JP-A-9-138495. The latter is preferred from the viewpoint of working environment. Specifically, there are methods of breaking through, peeling off, cutting off and push cutting the outlets of the packages, and methods described in JP-A-6-19102 and-JP-A-6-95331.

The hydrazine derivative for use in the present invention is described below. In the present invention, compounds of general formula (I) described in JP-A-7-287355 can be used. Specifically, compounds of I-1 to I-53 described therein can be used.

In addition, the following hydrazine derivatives can also preferably used.

Namely, compounds represented by (KA 1) described in JP-B-6-77138, specifically, compounds described on pages 3 and 4 thereof; compounds represented by general formula (I) described in JP-B-6-93082, specifically, compounds 1 to 38 described on pages 8 to 18 thereof; compounds represented by general formulas (4), (5) and (6) described in JP-A-6-230497, specifically, compounds 4-1 to 4-10 described on pages 25 and 26 thereof, compounds 5-1 to 5-42 described on pages 28 to 36 and compounds 6-1 to 6-7 described on pages 39 and 40; compounds represented by general formulas (1) and (2) described in JP-A-6-289520, specifically, compounds 1-1) to 1-17) and 2-1) described on pages 5 to 7 thereof; compounds represented by (KA 2) and (KA 3) described in JP-A-6-313936, specifically, compounds described on pages 6 to 19 thereof; compounds represented by (KA 1) described in JP-A-6-313951, specifically, compounds described on pages 3 to 5 thereof; compounds represented by general formula (I) described in JP-A-7-5610, specifically, compounds I-1 to I-38 described on pages 5 to 10 thereof; compounds represented by general formula (II) described in JP-A-7-77783, specifically, compounds II-1 to II-102 described on pages 10 to 27 thereof; compounds represented by general formulas (H) and (Ha) described in JP-A-7-104426, specifically, compounds H-1 to H-44 described on pages 8 to 15 thereof; compounds each having an anionic group or a nonionic group forming an intermolecular hydrogen bond with a hydrogen atom of hydrazine, in the vicinity of a hydrazine group, described in JP-A-9-22082, particularly, compounds represented by general formulas (A), (B), (C), (D), (E) and (F), specifically, compounds N-1 to N-30 described therein; and compounds represented by general formula (1) described in JP-A-9-22082, specifically, compounds D-1 to D-55 described therein.

In the present invention, the hydrazine nucleating agent can be used by dissolving it in an appropriate water-miscible organic solvent, for example, alcohols (such as methanol, ethanol, propanol and fluorinated alcohol), ketones (such as acetone and methyl ethyl ketone), dimethylformamide, dimethyl sulfoxide and methyl cellosolve.

Alternatively, the hydrazine nucleating agent can be used by dissolving it using an oil such as dibutyl phthalate, tricresyl phosphate, glyceryl triacetate and diethyl phthalate, or an auxiliary solvent such as ethyl acetate and cyclohexanone by a well known emulsifying dispersion method to mechanically prepare emulsified dispersions. Further alternatively, the hydrazine derivative can be used by dispersing the powder thereof in water in a ball mill or a colloid mill, or with ultrasonic waves by methods known as the solid dispersion methods.

The hydrazine nucleating agent for use in the present invention may be added to any of the silver halide emulsion layers and other hydrophilic colloidal layers provided on the silver halide emulsion layer side with respect to the support. However, the hydrazine nucleating agent is preferably added to the silver halide emulsion layers or hydrophilic colloidal layers adjacent thereto.

In the present invention, the amount of the nucleating agent added is preferably $1\times10^{-6}$ mol to $1\times10^{-2}$ mol, more preferably $1\times10^{-5}$ mol to $5\times10^{-3}$ mol, and most preferably $2\times10^{-5}$ mol to $5\times10^{-3}$ mol, per mol of silver halide.

Preferred hydrazine derivatives for use in the present invention are represented by general formula (NB):

$$A\text{-}(B)_m \qquad \text{(NB)}$$

wherein A represents a connecting group, m represents an integer of 2 to 6, and B represents a group represented by the following general formula (B-1):

$$-(L_2-Ar_2)_n-L_1-Ar_1-NHNH-G_1-R_1 \qquad \text{(B-1)}$$

wherein $Ar_1$ and $Ar_2$ each represents an aromatic group or an aromatic heterocyclic group; $L_1$ and $L_2$ each represents a connecting group; n represents 0 or 1; $R_1$ represents a hydrogen atom, an alkyl group, an aryl group, a heterocyclic group, an alkoxyl group, an aryloxy group, an amino group or a hydrazino group; $G_1$ represents —CO—, —$SO_2$—, —SO—, —P($R_2$)(=O)—, —CO—CO—, a thiocarbonyl group or an iminomethylene group; and $R_2$ is selected from the those defined for $R_1$ and may be different from $R_1$.

In general formula (B-1), the aromatic groups represented by $Ar_1$ and $Ar_2$ are monocyclic or bicyclic aryl groups such as benzene rings or naphthalene rings. The aromatic heterocyclic groups represented by $Ar_1$ and $Ar_2$ are monocyclic or bicyclic aromatic heterocyclic groups, and may be cyclo-condensed with other aryl groups. Examples thereof include pyridine, pyrimidine, imidazole, pyrazole, quinoline, isoquinoline, benzimidazole, thiazole and benzothiazole rings.

$Ar_1$ and $Ar_2$ are preferably aromatic groups, and more preferably phenylene groups.

$Ar_1$ and $Ar_2$ may be substituted, and typical examples of the substituent groups include alkyl (including active methine), alkenyl, alkynyl, aryl, heterocyclic, quaternized nitrogen atom-containing heterocyclic, (for example, pyridinio), hydroxyl, alkoxyl (including groups repeatedly containing ethyleneoxy group or propyleneoxy group units), aryloxy, acyloxy, acyl, alkoxycarbonyl, aryloxycarbonyl, carbamoyl, urethane, carboxyl (including salts thereof), imido, amino, carbonamido, sulfonamido, ureido, thioureido, sulfamoylamino, semicarbazido, thiosemicarbazido, hydrazino, quaternary ammonio, mercapto, (alkyl, aryl or heterocyclic) thio, (alkyl or aryl) sulfonyl, (alkyl or aryl)sulfinyl, sulfo (including salts thereof), sulfamoyl, acylsulfamoyl, (alkyl or aryl) sulfonylureido, (alkyl or aryl)sulfonylcarbamoyl, halogen atoms, cyano, nitro, phosphoric acid amido, groups each having a phosphoric ester structure, acylureido, selenium or tellurium atom-containing groups, groups each having a tertiary or quaternary sulfonium structure and quaternized phosphorus atom-containing groups. These substituent groups may be further substituted by these substituent groups.

Preferred examples of the substituent groups include alkyl having 1 to 20 carbon atoms, aralkyl, heterocyclic, substituted amino, acylamino, sulfonamido, ureido, sulfamoylamino, imido, thioureido, phosphoric acid amido, hydroxyl, alkoxyl, aryloxy, acyloxy, acyl, alkoxycarbonyl, aryloxycarbonyl, carbamoyl, carboxyl (including salts thereof), (alkyl, aryl or heterocyclic) thio, sulfo (including salts thereof), sulfamoyl, halogen atoms, cyano and nitro.

$Ar_1$ is preferably an unsubstituted phenylene group.

In general formula (B-1), the alkyl group represented by $R_1$ is preferably an alkyl group having 1 to 10 carbon atoms, and the aryl group is preferably a monocyclic or bicyclic aryl group, for example, a group containing a benzene ring.

The heterocyclic group is a 5- or 6-membered ring compound containing at least one of nitrogen, oxygen and sulfur atoms. Examples thereof include imidazolyl, pyrazolyl, triazolyl, tetrazolyl, pyridyl, pyridinio, quinolinio and quinolinyl. Pyridyl and pyridinio are particularly preferred.

The alkoxyl group is preferably an alkoxyl group having 1 to 8 carbon atoms, and the aryloxy group is preferably a monocyclic group. The amino group is preferably an unsubstituted amino group, or an alkylamino, arylamino or substituted or unsubstituted heterocyclic amino group having 1 to 10 carbon atoms.

$R_1$ may be substituted, and the preferred substituent groups are the same as shown as the substituent groups for $Ar_1$ and $Ar_2$.

Of the groups represented by $R_1$, when $G_1$ is a —CO— group, preferred groups include a hydrogen atom, an alkyl group (for example, methyl, trifluoromethyl, difluoromethyl, 2-carboxytetrafluoroethyl, pyridiniomethyl, 3-hydroxypropyl, 3-methanesulfonamidopropyl or phenylsulfonylmethyl), an aralkyl group (for example, o-hydroxybenzyl) and an aryl group (for example, phenyl, 3,5-dichlorophenyl, o-methanesulfonamido-phenyl, o-carbamoylphenyl, 4-cyanophenyl or 2-hydroxymethylphenyl). In particular, a hydrogen atom and an alkyl group are preferred.

When $G_1$ is an —$SO_2$— group, $R_1$ is preferably an alkyl group (for example, methyl), an aralkyl group (for example, o-hydroxybenzyl), an aryl group (for example, phenyl) or a substituted amino group (for example, dimethylamino).

When $G_1$ is a —COCO— group, $R_1$ is preferably an alkoxyl group, an aryloxy group or an amino group. In particular, an alkylamino group, an arylamino group or a heterocyclic amino group (including a quaternized nitrogen atom-containing heterocyclic group) is preferred. Examples thereof include 2,2,6,6-tetramethylpiperidine-4-ylamino, propylamino, anilino, o-hydroxyanilino, 5-benzotriazolylamino and N-benzyl-3-pyridinioamino).

Further, $R_1$ may be a group which cleaves the $G_1$—$R_1$ moiety from the residual molecule to induce the cyclization reaction for forming a cyclic structure containing atoms of the —$G_1$—$R_1$ moiety, and examples thereof include groups described in JP-A-63-29751.

An adsorptive group which is adsorbed by a silver halide may be incorporated into the compound represented by general formula (NB). Such adsorptive groups include groups such as alkylthio, arylthio, thiourea, thioamido, mercapto heterocyclic and triazole described in U.S. Pat. Nos. 4,385,108 and 4,459,347, JP-A-59-195233, JP-A-59-200231, JP-A-59-201045, JP-A-59-201046, JP-A-59-201047, JP-A-59-201048, JP-A-59-201049, JP-A-61-170733, JP-A-61-270744, JP-A-62-948, JP-A-63-234244, JP-A-63-234245 and JP-A-63-234246. These adsorptive groups to the silver halides may be precursors thereof. Such precursors include groups described in JP-A-2-285344.

In general formula (B-1), the connecting groups represented by $L_1$ and $L_2$ each represents —O—, —S—, —N($R_N$)— (wherein RN represents a hydrogen atom, an alkyl group or an aryl group), —CO—, —C(=S)—, —$SO_2$—, —SO—, —P=O— or an alkylene group, which may be alone or a combination thereof. Specific examples of the combined groups include —CON($R_N$)—, —$SO_2$N($R_N$)—, —COO—, —N($R_N$)CON($R_N$)—, —N($R_N$)CSN($R_N$)—, —N($R_N$)$SO_2$N($R_N$)—, —$SO_2$N($R_N$)CO—, —$SO_2$N($R_N$)CON($R_N$)—, —N($R_N$)COCON($R_N$)—, —CON($R_N$)CO—, —S-alkylene group-CONH—, —O-alkylene group-CONH— and —O-alkylene group-NHCO—. These groups may be connected from either the right or the left.

When the connecting groups represented by $L_1$ and $L_2$ in general formula (B-1) each contains a trivalent or more valent group, $L_1$ may connect two or more groups represented by —$Ar_1$—NHNH—$G_1$—$R_1$ in general formula (B-1), and $L_2$ may connect two or more groups represented by —$Ar_2$—$L_1$—$Ar_1$—NHNH—$G_1$—$R_1$ in general formula (B-1).

In this case, the trivalent or more valent connecting group contained in each of $L_1$ and $L_2$ is specifically an amino group or an alkylene group.

In general formula (B-1), $L_1$ is preferably —$SO_2$NH—, —NHCONH—, —NHC(=S)NH—, —OH—, —S—, —N($R_N$)— or an active methylene group, and particularly preferably —$SO_2$NH—. $L_2$ is preferably —CON($R_N$)—, —$SO_2$N($R_N$)—, —COO—, —N($R_N$)CON($R_N$)— or —N($R_N$)CSN($R_N$)—.

The connecting group represented by A in general formula (NB) is a divalent to hexavalent connecting group which can connect 2 to 6 groups represented by B, such as —O—, —S—, —N($R_N$')— (wherein $R_N$' represents a hydrogen atom, an alkyl group or an aryl group), —$N^+$($R_N$')$_2$— (wherein each $R_N$' may be the same or different, and may combine with each other to form a ring), —CO—, —C(=S)—, —$SO_2$—, —SO—, —P=O—, an alkylene group, a cycloalkylene group, an alkenylene group, an alkynylene group, an arylene group or a heterocyclic group, which may be alone, a combination thereof or a single bond. The heterocyclic group as used herein may be a heterocyclic group containing a quaternized nitrogen atom such as a pyridinio group.

The connecting group represented by A in general formula (NB) may be substituted. Examples of the substituent group include those exemplified as the substituent group for $Ar_1$ and $Ar_2$ in general formula (B-1).

When n is 0, the connecting group represented by A preferably contains at least one of a benzene ring, a naphthalene ring, a saturated or unsaturated heterocyclic ring, a heterocyclic ring containing a quaternized nitrogen atom such as a pyridinio group, a quaternized nitrogen atom such as an ammonio group and a cycloalkylene group.

When n is 1, the connecting group represented by A preferably contains at least one of a single bond, a benzene ring, a naphthalene ring, a saturated or unsaturated heterocyclic ring, a heterocyclic ring containing a quaternized nitrogen atom such as a pyridinio group, a quaternized nitrogen atom such as an ammonio group and a cycloalkylene group.

In general formula (NB), m represents an integer from 2 to 6. It is however preferably 2, 3 or 4, and more preferably 2 or 3.

In the present invention, the addition amount of the compound of general formula (NB) is preferably $1\times10^{-6}$ mol to $1\times10^{-2}$ mol, more preferably $1\times10^{-5}$ mol to $5\times10^{-3}$ mol, and most preferably $2\times10^{-5}$ mol to $5\times10^{-3}$ mol, per mol of silver halide.

Specific examples of the compounds represented by general formula (NB) are enumerated below, but the present invention is not limited thereto.

| | | R = | | | |
|---|---|---|---|---|---|
| | | —H | —$CF_2H$ | 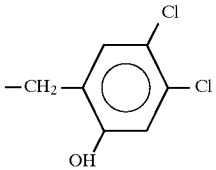 | —$CONHC_3H_7$ |
| 1 | 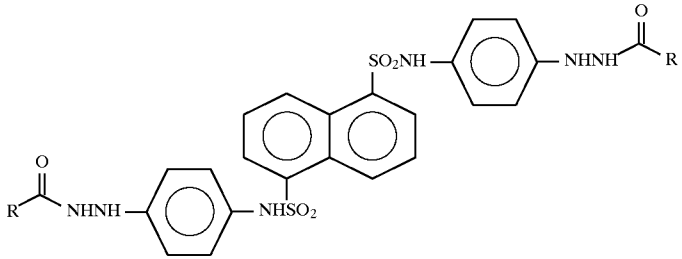 | 1a | 1e | 1k | 1l |
| 2 | 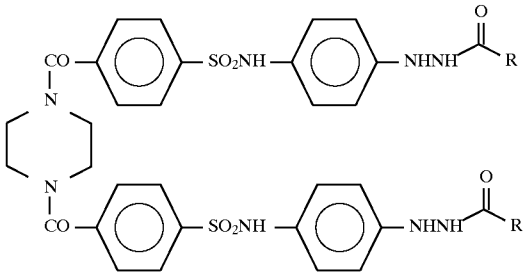 | 2a | 2e | 2k | 2l |
| 3 | 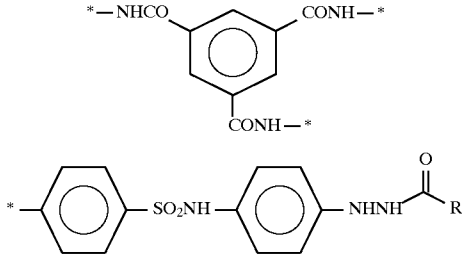 | 3a | 3e | 3k | 3l |

-continued
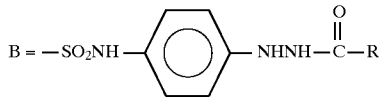
| | | R = | | | |
|---|---|---|---|---|---|
| | | —H | —$CF_2H$ | —$CF_3$ | —$CF_2SCH_3$ |
| 4 | 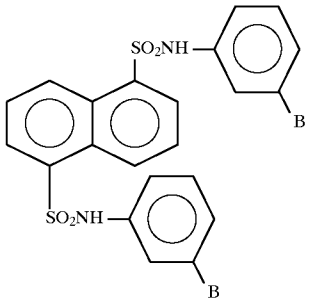 | 4a | 4e | 4c | 4r |
| 5 | 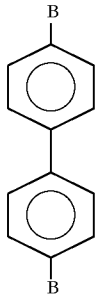 | 5a | 5e | 5c | 5r |
| 6 | 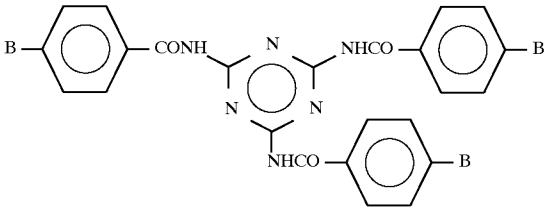 | 6a | 6e | 6c | 6r |

-continued
| | | | | | |
|---|---|---|---|---|---|
| 7 | 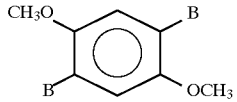 | 7a | 7e | 7c | 7r |
| 8 | 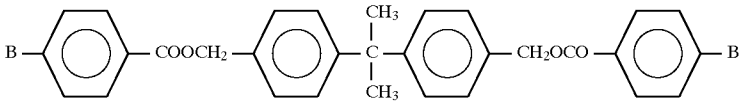 | 8a | 8e | 8c | 8r |
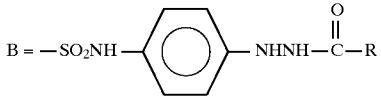
| | R = | | | |
|---|---|---|---|---|
| | −H | $-CF_2H$ | $-CONHCH_3$ | $-CF_2OCH_3$ |
| 9 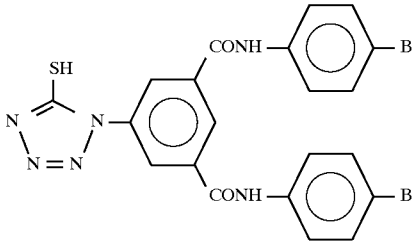 | 9a | 9e | 9p | 9b |
| 10 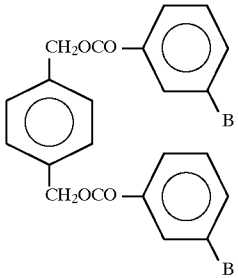 | 10a | 10e | 10p | 10b |

-continued
| | | R = | | | |
|---|---|---|---|---|---|
| | | —H | —$CF_2H$ | $HOCH_2$ | —CONH— NH |
| 11 | 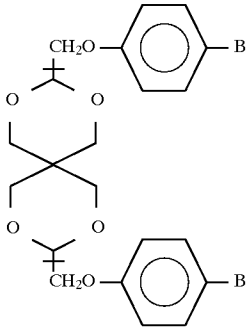 | 11a | 11e | 11f | 11g |
B' = 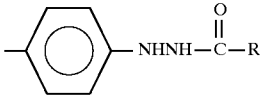
| | | R = | | | |
|---|---|---|---|---|---|
| | | —H | —$CF_2H$ | —CONH— OH | —CONH— NH |
| 12 | 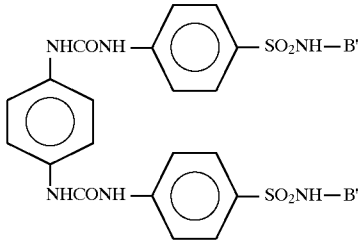 | 12a | 12e | 12s | 12g |

-continued
| | | | | | |
|---|---|---|---|---|---|
| 13 | 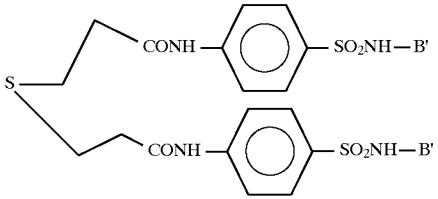 | 13a | 13e | 13s | 13g |
| 14 | 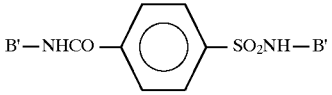 | 14a | 14e | 14s | 14g |
| 15 | 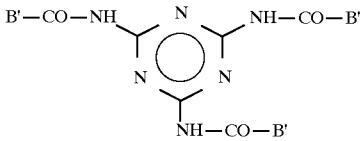 | 15a | 15e | 15s | 15g |
| 16 | 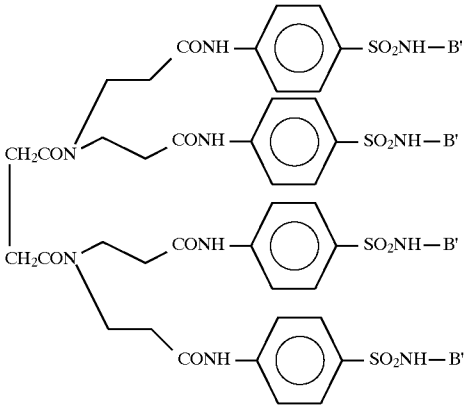 | 16a | 16e | 16s | 16g |
| 17 | 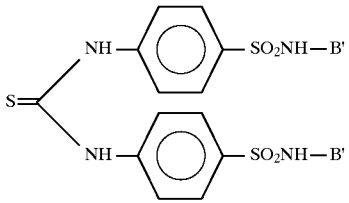 | 17a | 17e | 17s | 17g |

-continued
18
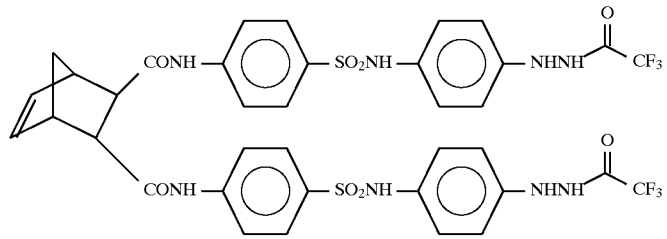
19
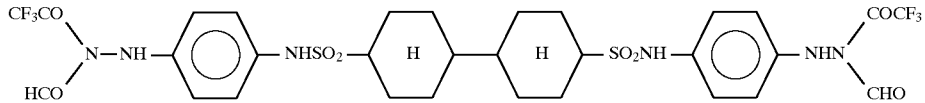
20
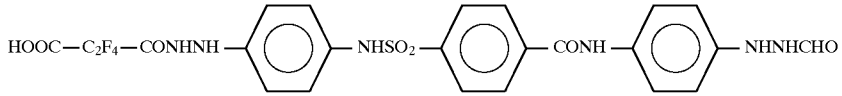
21
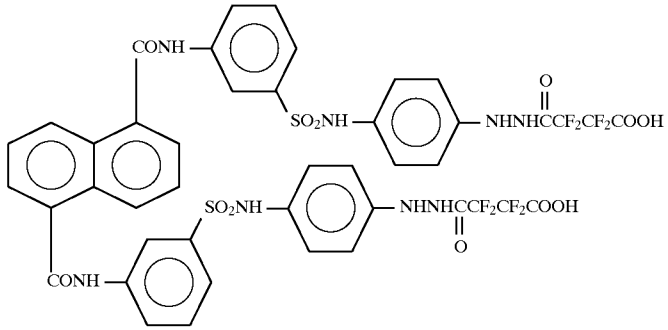

-continued
| | | | | | | |
|---|---|---|---|---|---|---|
| 22 | 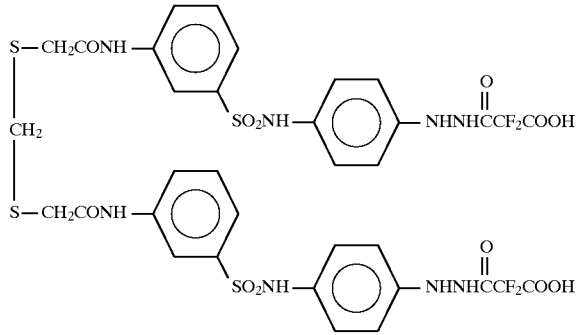 | | | | | |
| | B' = 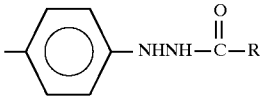 | R = | | | | |
| | | —H | —CF$_3$ | —CF$_2$H | 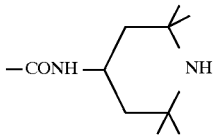 | 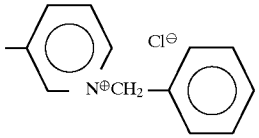 |
| 23 | 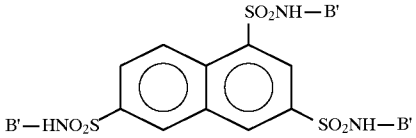 | 23a | 23c | 23e | 23g | 23d |
| 24 | 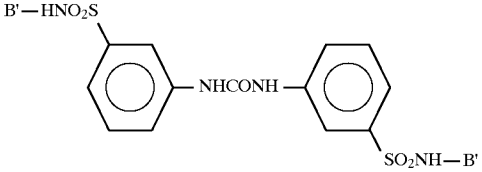 | 24a | 24c | 24e | 24g | 24d |
| 25 | 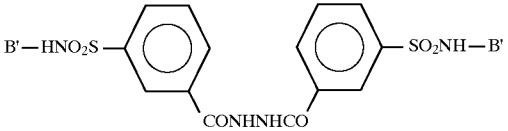 | 25a | 25c | 25e | 25g | 25d |

-continued
| | | | | | | | |
|---|---|---|---|---|---|---|---|
| 26 | 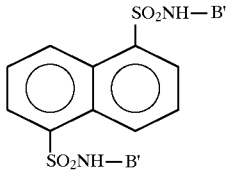 | 26a | 26c | 26e | 26g | | 26d |
B' = 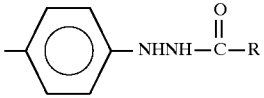
| | R = | | | | | |
|---|---|---|---|---|---|---|
| | —H | —$CF_3$ | —$CF_2H$ | —$CONHCH_3$ | 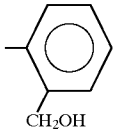 | —$C_2F_4COOH$ |
| 27 | 27a | 27c | 27e | 27p | 27f | 27t |
| 28 | 28a | 28c | 28e | 28p | 28f | 28t |
| 29 | 29a | 29c | 29e | 29p | 29f | 29t |
27: 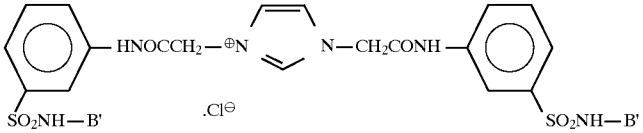
28: 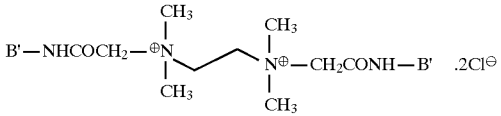
29: 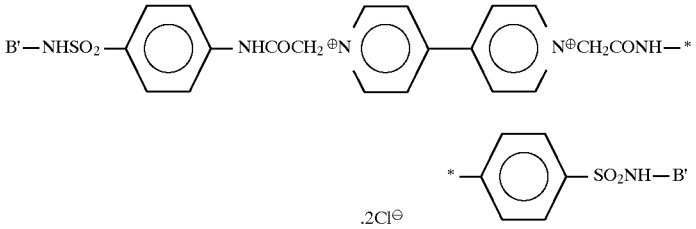

-continued
| | | | | | | |
|---|---|---|---|---|---|---|
| 30 | 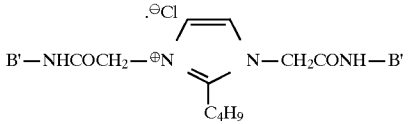 | 30a | 30c | 30e | 30p | 30f | 30t |

Nucleating accelerators for use in the present invention include amine derivatives, onium salts, disulfide derivatives and hydroxymethyl derivatives. Examples thereof are enumerated below:

Compounds described in JP-A-7-77783, page 48, lines 2 to 37, specifically, compounds A-1) to A-73) described on pages 49 to 58; compounds represented by (KA 21), (KA 22) and (KA 23) described in JP-A-7-84331, specifically, compounds described on pages 6 to 8 thereof; compounds represented by general formulas [Na] and [Nb] described in JP-A-7-104426, specifically, compounds Na-1 to Na-22 and Nb-1 to Nb-12 described on pages 16 to 20 thereof: and compounds represented by general formulas (1) to (7) described in JP-A-8-272023, specifically, compounds 1-1 to 1-19, 2-1 to 2-22, 3-1 to 3-36, 4-1 to 4-5, 5-1 to 5-41, 6-1 to 6-58 and 7-1 to 7-38 described therein.

The nucleating accelerators for use in the present invention can be used by dissolving them in appropriate water-miscible organic solvents, for example, alcohols (such as methanol, ethanol, propanol and fluorinated alcohol), ketones (such as acetone and methyl ethyl ketone), dimethylformamide, dimethyl sulfoxide and methyl cellosolve.

Alternatively, the nucleating accelerators can be used by dissolving them using oils such as dibutyl phthalate, tricresyl phosphate, glyceryl triacetate and diethyl phthalate, or auxiliary solvents such as ethyl acetate and cyclohexanone by the emulsifying dispersion methods already well known to mechanically prepare emulsified dispersions. Further alternatively, the nucleating accelerators can be used by dispersing the powder thereof in water in a ball mill or a colloid mill, or with ultrasonic waves by methods known as the solid dispersion methods.

The nucleating accelerator for use in the present invention may be added to any of the silver halide emulsion layers and other hydrophilic colloidal layers on the silver halide emulsion layer side with respect to the support. However, the nucleating accelerator is preferably added to the silver halide emulsion layers or hydrophilic colloidal layers adjacent thereto. In the present invention, the amount of the nucleating accelerator added is preferably $1\times10^{-6}$ mol to $2\times10^{-2}$ mol, more preferably $1\times10^{-5}$ mol to $2\times10^{-2}$ mol, and most preferably $2\times10^{-5}$ mol to $1\times10^{-2}$ mol, per mol of silver halide.

As the silver halide emulsion for use in the silver halide photographic material, at least two kinds of silver halide emulsions each comprising a spectrally sensitized silver halide grains are used in the present invention. These silver halide emulsions for use in the present invention are all sensitive to the same exposure wavelength, and have sensitivities different from one another. The spectral sensitivity of the silver halide emulsion can be changed by the difference in mean grain size of silver halide grains, the difference in halogen composition, the kind and amount of heavy metal contained in grains, the degree of chemical sensitization, the shape of grains or the amount adsorbed by silver halide grains, when the same sensitizing dye is used. Even when the grain size, the halogen composition and the shape of grains are the same, the sensitivity can be changed by the use of a different sensitizing dye. The sensitivity difference can therefore be given by the difference in grain size, the difference in halogen composition, the difference in the heavy metal contained in grains, the difference in the degree of chemical sensitization, the shape of grains or the use of the different sensitizing dye. The sensitivity difference is preferably 1.5 to 50 times, and more preferably 2 to 10 times, when it is expressed in terms of the ratio of a relative value of the reciprocal of an exposure giving a definite density.

Although there is no particular limitation on the ratio of the silver halide emulsions of different kinds used in combination, it is preferred that the ratio of an emulsion having a higher sensitivity is low. The ratio of an emulsion having a higher sensitivity to an emulsion having a lower sensitivity is generally from 1:1 to 1:20, and more preferably from 1:2 to 1:10, on the basis of silver weight contained in the silver halide emulsion.

The silver halide emulsions of different kinds may be contained in the same layer or separate layers. When the silver halide emulsions of different kinds are mixed in the same layer, the sensitizing dye may be added to a mixture of the silver halide emulsions of different kinds, or may be previously added to the different kinds silver halide emulsions, respectively, followed by mixing with each other. When the silver halide emulsions are mixed after the addition of the sensitizing dye, either the same sensitizing dye or a different sensitizing dye may be added to each of the emulsions.

The silver halide emulsions used in the present invention may contain any of silver chloride, silver bromide, silver chlorobromide, silver chloroiodobromide and silver iodobromide. However, the content of silver chloride is preferably 30 mol % or more, and more preferably 50 mol % or more. Further, the content of silver iodide is preferably 5 mol % or less, and more preferably 2 mol % or less.

Although silver halide grains may have any of the cubic, tetradecahedral, octahedral, irregular and tabular forms, the cubic or tabular form is preferred.

The photographic emulsions used in the present invention can be prepared by the use of the methods described in P. Glafkides, *Chimie et Physique Photographigue* (Paul Montel, 1967), G. F. Duffin, *Photographic Emulsion Chemistry* (The Focal Press, 1966) and V. L. Zelikman et al., *Making and Coating Photographic Emulsion* (The Focal Press, 1964).

That is, either the acidic process or the neutral process may be employed, and a soluble silver salt and a soluble halogen salt may be reacted with each other by using any of the single jet process, the double jet process and a combination thereof.

A process in which grains are formed in the presence of excess silver ions (so-called reverse mixing process) can also be used. As a type of double jet process, a process of maintaining the pAg in a liquid phase constant in which a silver halide is formed, namely the so-called controlled double jet process, can also be used. Further, it is preferred that solvents for silver halides such as ammonium, thioether and four-substituted thiourea are used to form grains. More preferably, four-substituted thiourea compounds are used, which are described in JP-A-53-82408 and JP-A-55-77737. Preferred examples of the thiourea compounds are tetramethylthiourea and 1,3-dimethyl-2-imidazolidine-thione. The amount of the solvents for silver halides added is preferably $10^{-5}$ mol to $10^{-2}$ mol per mol of silver halide, although it varies depending on the kind of compound used, and the desired grain size and halogen composition.

According to the controlled double jet process and the grain forming process using the solvents for silver halides, silver halide emulsions having a regular crystal form and a narrow grain size distribution can be easily prepared. These processes are useful means for preparing the silver halide emulsions used in the present invention.

Further, in order to homogenize the grain size, it is preferred that grains are allowed to grow rapidly within the range not exceeding the critical degree of saturation by a method of changing the addition rate of silver nitrate and alkali halides depending on the growth speed of grains as described in British Patent 1,535,016, JP-B-48-36890 and JP-B-52-16364, and a method of changing the concentration of aqueous solutions as described in British Patent 4,242,445 and JP-A-55-158124.

The emulsions for use in the present invention are preferably monodisperse emulsions, and the coefficient of variation thereof expressed by {(standard deviation of grain size)/(mean grain size)}×100 is preferably 20% or less, and more preferably 15% or less.

The mean grain size of the grains contained in the silver halide emulsions is preferably 0.5 μm or less, and more preferably 0.1 μm to 0.4 μm.

The silver halide emulsions used in the present invention may contain metals belonging to group VIII. In particular, photographic materials suitable for high illumination exposure such as scanner exposure and photographic materials for line shooting preferably contain rhodium compounds, iridium compounds, ruthenium compounds or the like in order to achieve high contrast and low fog. It is also preferable to contain iron compounds for enhancement in sensitivity.

As the rhodium compounds for use in the present invention, water-soluble rhodium compounds can be used. Examples thereof include rhodium (III) halide compounds or rhodium complex salts having halogens, amines, oxalato or the like as ligands, for example, hexachlororhodium (III) complex salts, hexabromorhodium (III) complex salts, hexaaminerhodium (III) complex salts and trioxalatorhodium (III) complex salts. These rhodium compounds are used by dissolving them in water or appropriate solvents. In order to stabilize the solution of the rhodium compound, a method of adding an aqueous solution of a hydrogen halide (for example, hydrochloric acid, hydrobromic acid or hydrofluoric acid) or an alkali halide (for example, KCl, NaCl, KBr or NaBr), which is generally frequently used, can be used. Instead of the use of the water-soluble rhodium, it is also possible to add and dissolve other silver halide grains previously doped with rhodium in preparing the silver halide.

The iridium compounds for use in the present invention include hexachloroiridium, hexabromoiridium and hexaaminoiridium. The ruthenium compounds for use in the present invention include hexachlororuthenium and pentachloronitrosylruthenium. The iron compounds used in the present invention include potassium hexacyanoferrate (III) and ferrous thiocyanate.

Rhenium, ruthenium and osmium for use in the present invention are added in the form of water-soluble complex salts described in JP-A-63-2042, JP-A-1-285941, JP-A-2-20852 and JP-A-2-20855. Particularly preferred examples thereof include six-coordinate complexes represented by the following formula:

$$[ML_6]^{-n}$$

wherein M represents Ru, Re or Os; and n represents 0, 1, 2, 3 or 4.

In this case, counter ions have no importance, and ammonium or alkali metal ions are used.

Preferred examples of ligands include halide ligands, cyanide ligands, cyanate ligands, nitrosyl ligands and thionitrosyl ligands. Specific examples of the complexes used in the present invention are shown below, but the present invention is not limited thereto.

| | | |
|---|---|---|
| $[ReCl_6]^{-3}$ | $[ReBr_6]^{-3}$ | $[ReCl_5(NO)]^{-2}$ |
| $[Re(NS)Br_5]^{-2}$ | $[Re(NO)(CN)_5]^{-2}$ | $[Re(O)_2(CN)_4]^{-3}$ |
| $[RuCl_6]^{-3}$ | $[RuCl_4(H_2O)_2]^{-1}$ | $[RuCl_5(NO)]^{-2}$ |
| $[RuBr_5(NS)]^{-2}$ | $[Ru(CN_6]^{-4}$ | $[Ru(CO)_3Cl_3]^{-2}$ |
| $[Ru(CO)Cl_5]^{-2}$ | $[Ru(CO)Br_5]^{-2}$ | |
| $[OsCl_6]^{-3}$ | $[OsCl_5(CO)]^{-2}$ | $[Os(NO)(CN)_5]^{-2}$ |
| $[Os(NS)Br_5]^{-2}$ | $[Os(CN)_6]^{-4}$ | $[Os(O)_2(CN)_4]^{-4}$ |

The addition amount of these compounds is $1\times10^{-8}$ mol to $5\times10^{-6}$ mol, and preferably $5\times10^{-8}$ mol to $1\times10^{-6}$ mol, per mol of silver contained in the silver halide emulsion.

Addition of these compounds can be appropriately conducted in preparing the silver halide emulsion grains and in each stage prior to coating of the emulsions. In particular, the compounds are preferably added upon forming the emulsions to incorporate them into the silver halide grains.

The silver halide emulsions for use in the present invention are preferably subjected to chemical sensitization. As the chemical sensitization methods, known methods such as sulfur sensitization, selenium sensitization, tellurium sensitization and noble metal sensitization can be used alone or in combination. When they are used in combination, for example, a combination of sulfur sensitization and gold sensitization, a combination of sulfur sensitization, selenium sensitization and gold sensitization, and a combination of sulfur sensitization, tellurium sensitization and gold sensitization are preferred.

The sulfur sensitization for use in the present invention is usually conducted by adding a sulfur sensitizer and stirring an emulsion at a high temperature of 40° C. or more for a definite period of time. As the sulfur sensitizers, known compounds can be used. Examples thereof include various sulfur compounds such as thiosulfates, thiourea compounds, thiazole compounds and rhodanine compounds, as well as sulfur compounds contained in gelatin. Preferred sulfur compounds are thiosulfates and thiourea compounds. Although the amount of the sulfur sensitizers added varies depending on various conditions such as the pH and the temperature in chemical ripening, and the size of silver halide grains, it is $10^{-7}$ mol to $10^{-2}$ mol, and more preferably $10^{-5}$ mol to $10^{-3}$ mol, per mol of silver halide.

In the present invention, known selenium compounds can be used as selenium sensitizers. That is, the selenium sensitization is usually conducted by adding an unstable type and/or non-unstable type selenium compound and stirring an emulsion at a high temperature of 40° C. or more for a definite period of time. As the unstable type selenium compounds, compounds described in JP-B-44-15748, JP-B-43-13489, JP-A-4-25832, JP-A-4-109240, JP-A-4-324855 can be used. In particular, compounds represented by general formulas (VIII) and (IX) in JP-A-4-324855 are preferably used.

Tellurium sensitizers for use in the present invention are compounds producing silver telluride presumed to form a sensitizing nucleus on a surface or in the inside of a silver halide grain. The forming rate of silver telluride in the silver halide emulsion can be tested by the method described in JP-A-5-313284.

Specifically, compounds can be used which are described in U.S. Pat. Nos. 1,623,499, 3,320,069 and 3,772,031, British Patents 235,211, 1,121,496, 1,295,462 and 1,396,696, Canadian Patent 800,958, JP-A-4-204640, JP-A-4-271341, JP-A-4-333043, JP-A-5-303157, *J. Chem. Soc. Chem. Commun.,* 635 (1980), ibid., 1102 (1979), ibid., 645 (1979), *J. Chem. Soc. Perkin. Trans.,* 1, 2191 (1980), *The*

*Chemistry of Organic Selenium and Tellurium Compounds*, vol.1, edited by S. Patai (1986) and ibid. vol. 2 (1987). In particular, the compounds represented by general formulas (II), (III) and (IV) in JP-A-5-313284 are preferably used.

The use amount of the selenium and tellurium sensitizers in the present invention is generally $10^{-8}$ mol to $10^{-2}$ mol, and preferably about $10^{-7}$ mol to about $10^{-3}$ mol, per mol of silver halide, although it varies depending on silver halide grains used, chemical ripening conditions and the like. There is no particular limitation on the conditions of chemical sensitization in the present invention. However, the pH is 5 to 8, the pAg is 6 to 11 and preferably 7 to 10, and the temperature is 40° C. to 95° C. and preferably 45° C. to 85° C.

Noble metal sensitizers for use in the present invention include gold, platinum, palladium and iridium, and particularly, gold sensitization is preferred. Examples of the gold sensitizers used in the present invention include chloroauric acid, potassium chloroaurate, potassium aurithiocyanate and gold sulfide. They can be used in an amount of about $10^{-7}$ mol to about $10^{-2}$ mol per mol of silver halide.

In the course of formation of the silver halide grains and physical ripening, cadmium salts, sulfites, lead salts and thallium salts may be allowed to coexist with the silver halide emulsions used in the present invention.

In the present invention, reduction sensitization can be used. As reduction sensitizers, stannous salts, amines, formamidinesulfinic acid and silane compounds can be used.

Thiosulfonic acid compounds may be added to the silver halide emulsions used in the present invention by the method shown in EP-293,917.

The light-sensitive silver halide emulsions for use in the present invention may be spectrally sensitized to blue, green, red or infrared light having relatively long wavelengths by the use of sensitizing dyes. The sensitizing dyes which can be used include cyanine dyes, merocyanine dyes, complex cyanine dyes, complex merocyanine dyes, holopolar cyanine dyes, styryl dyes, hemicyanine dyes, oxonol dyes and hemioxonol dyes.

The useful sensitizing dyes for use in the present invention are described, for example, in *Research Disclosure*, Item 17643 IV-A, page 23 (December, 1978), ibid., Item 1831 X, page 437 (August, 1978), U.S. Pat. Nos. 4,425,425 and 4,425,426, and literatures cited therein.

In particular, sensitizing dyes having spectral sensitivities suitable for spectral characteristics of light sources of various scanners, image setters and process cameras can be advantageously selected.

For example, the following sensitizing dyes are advantageously selected:

A) For argon laser light sources, compounds (I)-1 to (I)-8 described in JP-A-60-162247, compounds I-1 to I-28 described in JP-A-2-48653, compounds I-1 to I-13 described in JP-A-4-330434, compounds of Examples 1 to 14 described in U.S. Pat. No. 2,161,331 and compounds 1 to 7 described in West German Patent 936,071;

B) For helium-neon laser light sources, compounds I-1 to I-38 described in JP-A-54-18726, compounds I-1 to I-35 described in JP-A-6-75322 and compounds I-1 to I-34 described in JP-A-7-287338;

C) For LED light sources, dyes 1 to 20 described in JP-B-55-39818, compounds I-1 to I-37 described in JP-A-62-284343 and compounds I-1 to I-34 described in JP-A-7-287338;

D) For semiconductor laser light sources, compounds I-1 to I-12 described in JP-A-59-191032, compounds I-1 to I-22 described in JP-A-60-80841, compounds I-1 to I-29 described in JP-A-4-335342 and compounds I-1 to I-18 described in JP-A-59-192242; and E) For tungsten and xenon light sources for process cameras, compounds (1) to (19) represented by general formula [I] described in JP-A-55-45015, compounds I-1 to I-97 described in JP-A-9-160185 and compounds 4-A to 4-S, 5-A to 5-Q and 6-A to 6-T described in JP-A-6-242547.

These sensitizing dyes may be used alone or in combination. Combinations of the sensitizing dyes are often used particularly for supersensitization. The emulsions may contain dyes having no spectral sensitizing function by themselves, or substances which do not substantially absorb visible light and exhibit supersensitization, together with the sensitizing dyes.

The useful sensitizing dyes, the combinations of the dyes showing supersensitization, and the substances exhibiting supersensitization are described in *Research Disclosure,* 176, 17643 IV-J, page 23 (December, 1978) or JP-B-49-25500, JP-B-43-4933, JP-A-59-19032 and JP-A-59-192242 described above.

The sensitizing dyes for use in the present invention may be used as a combination of two or more thereof. When the sensitizing dyes are added to the silver halide emulsions, they may be either directly dispersed in the emulsions, or added to the emulsions as solutions thereof in individual or mixed solvents. The solvents include water, methanol, ethanol, propanol, acetone, methyl cellosolve, 2,2,3,3-tetrafluoropropanol, 2,2,2-trifluoroethanol, 3-methoxy-1-propanol, 3-methoxy-1-butanol, 1-methoxy-2-propanol and N,N-dimethylformamide.

Further, methods which can be used in the present invention include a method of dissolving a dye in a volatile organic solvent, dispersing the resulting solution into water or a hydrophilic colloid, and adding the resulting dispersion to an emulsion, as described in U.S. Pat. No. 3,469,987; a method of dissolving a dye in an acid, and the resulting solution is added to an emulsion, or dissolving a dye in water in the presence of an acid or a base, and adding the resulting aqueous solution to an emulsion, as described in JP-B-44-23389, JP-B-44-27555 and JP-B-57-22091; a method of dissolving or dispersing a dye into water in the presence of a surfactant, and adding the resulting aqueous solution or colloidal dispersion to an emulsion, as described in U.S. Pat. Nos. 3,822,135 and 4,006,025; a method of directly dispersing a dye into a hydrophilic colloid, and adding the resulting dispersion to an emulsion, as described in JP-A-53-102733 and JP-A-58-105141; and a method of dissolving a dye and adding the resulting solution to an emulsion, as described in JP-A-51-74624. Further, ultrasonic waves can also be applied to the solution.

The sensitizing dyes used in the present invention may be added at any stages of the preparation of the silver halide emulsions which have hitherto been accepted to be useful. For example, they may be added at a silver halide grain formation stage and/or before salt removal, during a silver removal stage and/or from after salt removal to before the start of chemical ripening, as described in U.S. Pat. Nos. 2,735,766, 3,628,960, 4,183,756 and 4,225,666, JP-A-58-184142 and JP-A-60-196749, or at any time and stage before the coating of emulsions, such as immediately before or during chemical ripening, or from after chemical ripening to the coating of the emulsions, as described in JP-A-58-113920. Furthermore, as disclosed in U.S. Pat. No. 4,225,666 and JP-A-58-7629, the same compound may be singly added, or in combination with a compound having a different structure, divided, for example, into during a grain formation stage and during or after chemical ripening, or before or during chemical ripening and after chemical ripening. The kinds of compounds added in parts and combinations thereof may be changed.

In the present invention, the sensitizing dye can be added in an amount of $4\times10^{-6}$ mol to $8\times10^{-3}$ mol per mol of silver halide, although the amount varies depending on the shape and the size of silver halide grains, the halogen composition, the method and the degree of chemical sensitization, and the kind of antifoggant. For example, when the size of silver halide grains is 0.2 $\mu$m to 1.3 $\mu$m, the sensitizing dye is added preferably in an amount of $2\times10^{-7}$ mol to $3.5\times10^{-6}$ mol, and more preferably, in an amount of $6.5\times10^{-7}$ mol to $2.0\times10^{-6}$ mol, per $m^2$ of surface area of silver halide grain.

There is no particular limitation on various additives used in the photographic materials in the present invention. For example, the following compounds can be preferably used.

Polyhydroxybenzene compounds described in JP-A-3-39948, page 10, lower right column, line 11 to page 12, lower left column, line 5, specifically, compounds (III)-1 to (III)-25 described therein;

Compounds substantially not having the absorption maxima in the visible region represented by general formula (I) described in JP-A-1-118832, specifically, compounds I-1 to I-26 described therein;

Antifoggants described in JP-A-2-103536, page 17, lower right column, line 19 to page 18, upper right column, line 4;

Polymer latexes described in JP-A-2-103536, page 18, lower left column, line 12 to line 20, polymer latexes having active methylene groups represented by general formula (I) described in JP-A-9-179228, and polymer latexes having a core/shell structure described in JP-A-9-179228;

Matte agents, lubricants and plasticizers described in JP-A-2-103536, page 19, upper left column, line 15 to upper right column, line 15;

Hardening agents described in JP-A-2-103536, page 18, upper right column, line 5 to line 17;

Compounds having acid groups described in JP-A-2-103536, page 18, lower right column, line 6 to page 19, upper left column, line 1;

Conductive materials described in JP-A-2-18542, page 2, lower left column, line 13 to page 3, upper right column, line 7, specifically, metal oxides described on page 2, lower right column, line 2 to line 10 of this patent, and conductive polymers of compounds P-1 to P-7 described therein;

Water-soluble dyes described in JP-A-2-103536, page 17, lower right column, line 1 to upper right column, line 18;

Solid disperse dyes represented by general formulas (FA), (FA1), (FA2) and (FA3) described in JP-A-9-179243, specifically, compounds F1 to F34 described therein, compounds (II-2) to (II-24), (III-5) to (III-18) and (IV-2) to (IV-7) described in JP-A-7-152112;

Solid disperse dyes described in JP-A-2-294638 and JP-A-5-11382;

Surfactants described in JP-A-2-12236, page 9, upper right column, line 7 to lower right column, line 3. PEG surfactants described in JP-A-2-103536, page 18, lower left column, line 4 to line 7. Fluorine-containing surfactants described in JP-A-3-39948, page 12, lower left column, line 6 to page 13, lower right column, line 5, specifically, compounds VI-1 to VI-15 described therein;

Redox compounds described in JP-A-5-274816 which can release development inhibitors by oxidation, preferably, redox compounds represented by general formulas (R-1), (R-2) and (R-3) described therein, specifically, compounds R-1 to R-68 described therein; and Binders described in JP-A-2-18542, page 3, lower right column, line 1 to line 20.

The present invention will be described in greater detail below with reference to the following Examples, but the invention should not be construed as being limited thereto.

EXAMPLE 1

Preparation of Emulsion A

| Solution 1 | |
|---|---|
| Water | 1 liter |
| Gelatin | 20 g |
| Sodium Chloride | 3.0 g |
| 1,3-Dimethyl-2-imidazolidine-2-thione | 20 mg |
| Sodium Benzenethiosulfonate | 8 mg |
| Solution 2 | |
| Water | 400 ml |
| Silver Nitrate | 100 g |
| Solution 3 | |
| Water | 400 ml |
| Sodium Chloride | 23.6 g |
| Potassium Bromide | 28.0 g |
| Ammonium Hexachloroiridate (III) (0.001% aqueous solution) | 6 ml |
| Potassium Hexachlororhodate (III) (0.001% aqueous solution) | 0.6 ml |

Solution 2 and solution 3 were concurrently added to solution 1 maintained at 50° C. at pH 4.5 with stirring over a time period of 20 minutes to form nuclear grains. Subsequently, solution 4 and solution 5 were added thereto over a time period of 20 minutes, and 0.15 g of potassium iodide was further added to terminate the grain formation.

| Solution 4 | |
|---|---|
| Water | 400 ml |
| Silver Nitrate | 100 g |
| Solution 5 | |
| Water | 400 ml |
| Sodium Chloride | 23.6 g |
| Potassium Bromide | 28.0 g |
| Potassium Hexacyanoferrate (II) (0.1% aqueous solution) | 10 ml |

Then, the grains were normally washed with water by the flocculation process, and 40 g of gelatin was added thereto.

After adjustment to pH 5.7 and pAg 7.5, 1.0 mg of sodium thiosulfate, 4.0 mg of chloroauric acid, 1.5 mg of triphenylphosphine selenide, 8 mg of sodium benzenethiosulfonate and 2 mg of sodium benzenethiosulfinate were added to conduct chemical sensitization at 55° C. so as to give optimum sensitivity.

Further, 100 mg of 4-hydroxy-6-methyl-1,3,3a,7-tetraazaindene was added as a stabilizer, and phenoxyethanol was added as a preservative to finally obtain cubic silver chloroiodobromide grain emulsion A having a mean grain size of 0.32 $\mu$m and a silver chloride content of 60 mol % (coefficient of variation of grain size: 9%).

Preparation of Emulsion B

The content of sodium chloride and potassium bromide and the amounts of ammonium hexachloroiridate (III), potassium hexachlororhodate (III) and potassium hexacyanoferrate (II) added in solutions 3 and 5 used for the preparation of emulsion A were changed, and the times over which solutions 2 and 3 and solutions 4 and 5 were each added and the temperature of solution 1 were adjusted to finally obtain cubic silver iodochlorobromide grain emulsion B having a mean grain size of 0.14 μm and a mean silver chloride content of 90 mol %, and containing 0.08 mol % of silver iodide (coefficient of variation of grain size: 12%).

Preparation of Coated Sample 1 (for Sensitivity Measurement)

Sensitizing dye (1) was added to emulsion A in an amount of $3.8\times10^{-4}$ mol/mol-Ag, and spectral sensitization was conducted. Further, $3.4\times10^{-4}$ mol/mol-Ag of KBr, $3.2\times10^{-4}$ mol/mol-Ag of compound (1), $8.0\times10^{-4}$ mol/mol-Ag of compound (2), $1.2\times10^{-2}$ mol/mol-Ag of hydroquinone, $3.0\times10^{-3}$ mol/mol-Ag of citric acid, $4.5\times10^{-4}$ mol/mol-Ag of compound (3) (a hydrazine derivative; this compound was added in the following manner and, as shown in Table 3, compounds (15) and (16) were also used in place of this compound, and the amounts thereof were changed), $6.0\times10^{-4}$ mol/mol-Ag of compound (4), 30% of a polyethyl acrylate latex and 30% of colloidal silica having a grain size of 0.01 μm, based on a gelatin binder, 100 mg/M$^2$ of aqueous latex (5), 150 mg/m$^2$ of a polyethyl acrylate dispersion, 150 mg/m$^2$ of a copolymer latex of methyl acrylate, sodium 2-acrylamido-2-methyl-propanesulfonate and 2-acetoacetoxyethyl methacrylate (weight ratio: 88:5:7), 150 mg/m$^2$ of a core-shell type latex (core: styrene/butadiene copolymer (weight ratio: 37/63), shell: styrene/2-acetoacetoxyethyl methacrylate copolymer (weight ratio: 84/16), core/shell ratio: 50/50), and 4% by weight of compound (6) based on gelatin were added thereto, and the pH of the solution was adjusted to 5.5 with citric acid. Then, an undercoated polyester support having a moisture-proof layer containing vinylidene chloride was coated therewith so as to give an amount of silver coated of 2.5 g/m$^2$ and an amount of gelatin coated of 1.3 g/m$^2$.

Addition of Hydrazine Derivative

An emulsified dispersion of the hydrazine derivative was prepared in the following manner. That is, 1 gram of the hydrazine derivative shown in Table 3, 6.0 g of poly(N-tert-butylacrylamide), and a solution composed of 48 ml of ethyl acetate and 2 ml of water were heated to 60° C. to dissolve them in the solution. The resulting solution was added to 120 ml of an aqueous solution containing 12 g of gelatin and 0.7 g of sodium dodecylbenzenesulfonate, and finely dispersed with a high-speed stirrer (a homogenizer, manufactured by Nippon Seiki Seisakusho) to obtain a emulsified dispersion of fine grains having a mean grain size of 0.3 μm. Proxel was further added as a preservative in an amount of 2000 ppm, based on gelatin, and finally, ascorbic acid was added to adjust the pH to 5.0. Then, the resulting solution was added to the coating solution.

| Upper Protective Layer | |
|---|---|
| Gelatin | 0.3 g/m$^2$ |
| Silica Matte Agent (mean grain size: 3.5 μm) | 25 mg/m$^2$ |
| Compound (7) (gelatin dispersion) | 20 mg/m$^2$ |
| Colloidal Silica (grain size: 10–20 μm) | 30 mg/m$^2$ |
| Compound (8) | 50 mg/m$^2$ |
| Sodium Dodecylbenzenesulfonate | 20 mg/m$^2$ |
| Compound (9) | 20 mg/m$^2$ |

-continued

| Upper Protective Layer | |
|---|---|
| Lower Protective Layer | |
| Gelatin | 0.5 g/m$^2$ |
| Compound (10) | 15 mg/m$^2$ |
| 1,5-Dihydroxy-2-benzaldoxime | 10 mg/m$^2$ |
| Polyethyl Acrylate Latex | 150 mg/m$^2$ |
| UL Layer | |
| Gelatin | 0.5 g/m$^2$ |
| Polyethyl Acrylate Latex | 150 mg/m$^2$ |
| Compound (6) | 40 mg/m$^2$ |
| Compound (11) | 10 mg/m$^2$ |

The supports of the samples used in the Examples each has a back layer and a conductive layer having the following compositions, respectively:

| Back Layer | |
|---|---|
| Gelatin | 3.3 g/m$^2$ |
| Sodium Dodecylbenzenesulfonate | 80 mg/m$^2$ |
| Compound (12) | 40 mg/m$^2$ |
| Compound (13) | 20 mg/m$^2$ |
| Compound (14) | 90 mg/m$^2$ |
| 1,3-Divinylsulfonyl-2-propanol | 60 mg/m$^2$ |
| Fine Polymethyl Methacrylate Grains (mean grain size: 6.5 μm) | 30 mg/m$^2$ |
| Compound (6) | 120 mg/m$^2$ |
| Conductive Layer | |
| Gelatin | 0.1 g/m$^2$ |
| Sodium Dodecylbenzenesulfonate | 20 mg/m$^2$ |
| $SnO_2$/Sb (weight ratio: 9/1, mean grain size: 0.25 μm) | 200 mg/m$^2$ |

Sensitizing Dye (1)

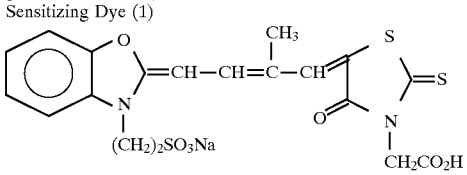

Compound (1)

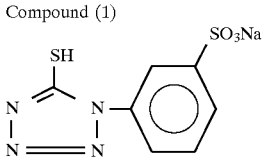

Compound (2)

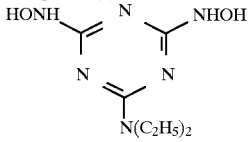

Compound (3)

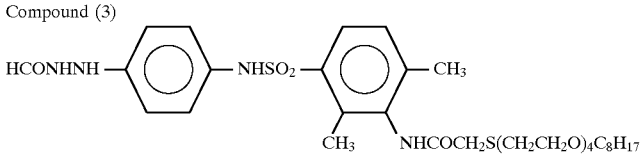

Compound (4)

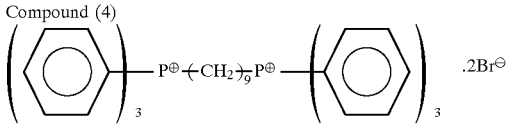

-continued

Compound (5)

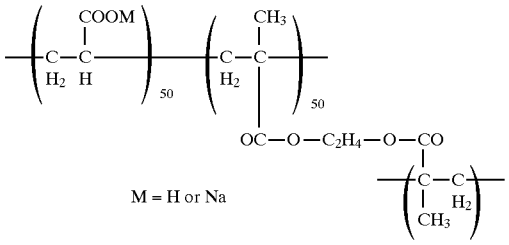

M = H or Na

Compound (6)

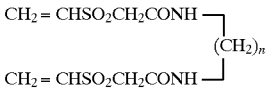

A 3:1 mixture of n = 2 and n = 3

Compound (7)

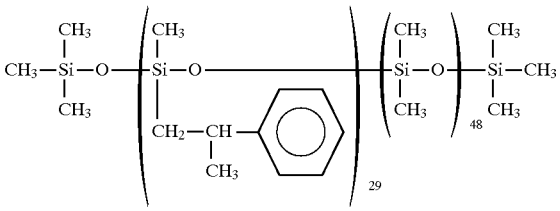

Compound (8)

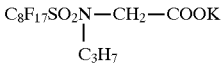

Compound (9)

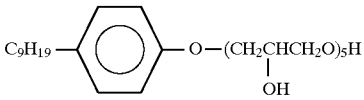

Compound (10)

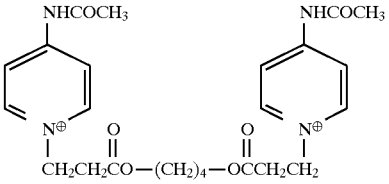

Compound (11)

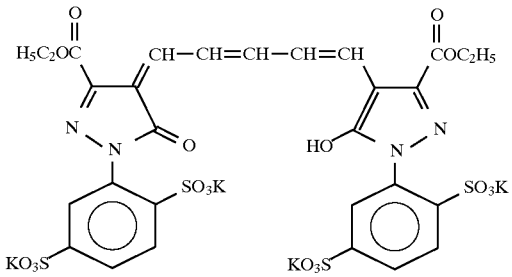

-continued

Compound (12)

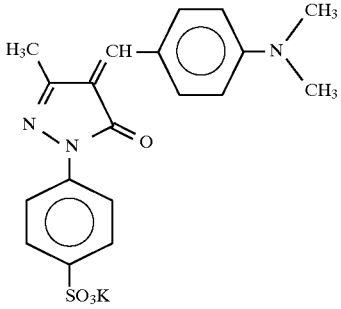

Compound (13)

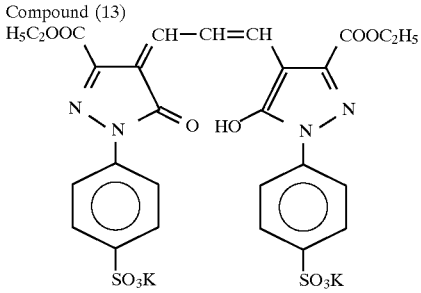

Compound (14)

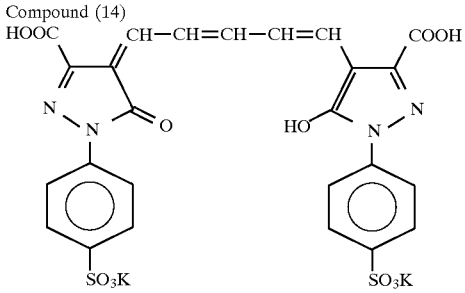

Preparation of Coated Sample 2 (for Sensitivity Measurement)

Coated sample 2 was prepared in the same manner as in the preparation of coated sample 1, with the exception that $4.0\times10^{-4}$ mol/mol-Ag of sensitizing dye (2) and $4.0\times10^{-4}$ mol/mol-Ag of sensitizing dye (3) were added in place of the addition of sensitizing dye (1).

Preparation of Coated Sample 3 (for Sensitivity Measurement)

Coated sample 3 was prepared in the same manner as in the preparation of coated sample 1, with the exception that $3.5\times10^{-4}$ mol/mol-Ag of sensitizing dye (4) was added in place of the addition of sensitizing dye (1).

Preparation of Coated Sample 4 (for Sensitivity Measurement)

Coated sample 4 was prepared in the same manner as in the preparation of coated sample 1, with the exception that emulsion B was used in place of emulsion A.

Preparation of Coated Sample 6 (for Experiment)

Coated sample 6 was prepared in the same manner as in the preparation of coated sample 1, with the exception that sensitizing dye (1) was added after mixing of emulsion A and emulsion B at a ratio of 1:5 on the basis of the silver weight, and then, spectral sensitization was performed.

Preparation of Coated Sample 7 (for Experiment)

Coated sample 7 was prepared in the same manner as in the preparation of coated sample 6, with the exception that $4.0\times10^{-4}$ mol/mol-Ag of sensitizing dye (2) and $4.0\times10^{-4}$ mol/mol-Ag of sensitizing dye (3) were added to emulsion A, $3.8\times10^{-4}$ mol/mol-Ag of sensitizing dye (1) was added to emulsion B, then, spectral sensitization was performed, and emulsion A and emulsion B after addition of the sensitizing dyes were mixed at a ratio of 1:5, instead of the addition of sensitizing dye (1) after mixing of the emulsions.

Preparation of Coated Sample 8 (for Experiment)

Coated sample 8 was prepared in the same manner as in the preparation of coated sample 7, with the exception that $3.5\times10^{-4}$ mol/mol-Ag of sensitizing dye (4) was added to emulsion A, instead of the addition of sensitizing dyes (2) and (3), and sensitizing dye (1) was not added to emulsion B.

Sensitizing Dye (2)

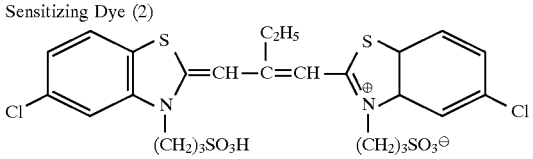

Sensitizing Dye (3)

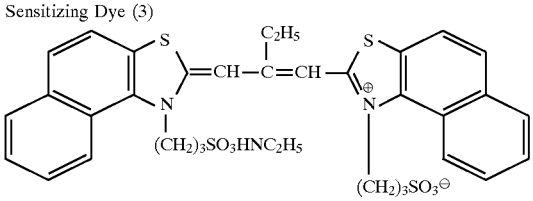

Sensitizing Dye (4)

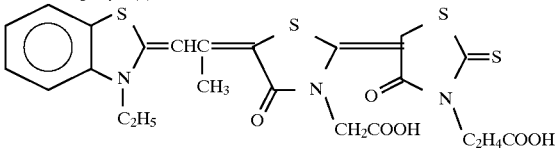

Compound (15)

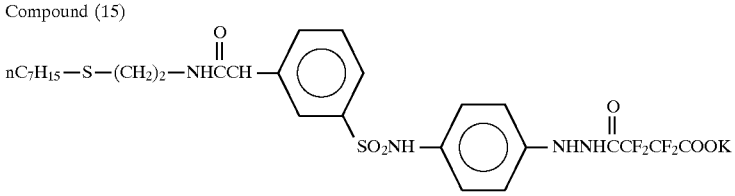

Compound (16)

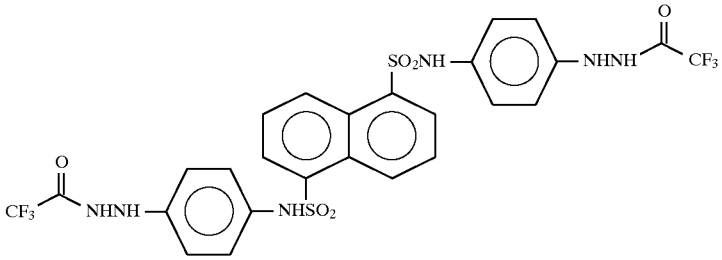

The compositions of developing solutions used are shown in Table 1, and the replenishment rate of the developing solutions is shown in Table 3.

TABLE 1

(Composition of Developing Solutions)

| No. | 1 | 2 | 3 |
|---|---|---|---|
| Diethylenetriamine-pentaacetic Acid | 2 g | 2 g | 2 g |
| Potassium Carbonate | 33 g | 33 g | 33 g |
| Sodium Carbonate | 28 g | 28 g | 28 g |
| Sodium Hydrogen-carbonate | 25 g | 25 g | 25 g |
| Sodium Erythorbate | 45 g | 45 g | 45 g |

TABLE 1-continued (Composition of Developing Solutions)

| No. | 1 | 2 | 3 |
|---|---|---|---|
| N-Methyl-p-amino-phenol | 7.5 g | — | — |
| Compound (A-2) of | — | 3 g | — |

TABLE 1-continued (Composition of Developing Solutions)

| No. | 1 | 2 | 3 |
|---|---|---|---|
| General Formula (I) Compound (A-23) of General Formula (I) | — | — | 3 g |
| KBr | 2 g | 2 g | 2 g |
| 5-Methylbenzotri-azole | 0.004 g | 0.004 g | 0.004 g |
| 1-Phenyl-5-mercapto-tetrazcle | 0.02 g | 0.02 g | 0.02 g |
| Sodium Sulfite | 10 g | 10 g | 10 g |
| pH | 9.7 | 9.7 | 9.7 |

In Table 1, water was added to bring the volume to 1 liter, and sodium hydroxide or acetic acid was used for the pH adjustment.

The samples were evaluated as follows.

Evaluation of Photographic Characteristics

The samples thus prepared were each exposed to xenon flash light having a light-emitting time of $10^{-6}$ second through an interference filter having a peak at 660 nm by the use of a step wedge, and developed at 35° C. for 15 seconds with an AP-560 automatic processor manufactured by Fuji Photo Film Co., Ltd., followed by fixing, washing and drying.

The sensitivity was indicated by the reciprocal of an exposure amount giving a density of 1.5, and a relative value of the sensitivity of each sample was calculated as $S_{1.5}$, when the sensitivity at the time when coated sample 1 was developed with developing solution 2 was taken as 100. The higher value shows the higher sensitivity.

As the indication (gamma) showing a contrast of an image, a slope of a straight line connecting a point of (fog+density 0.1) and a point of (fog+density 3.0) of a characteristic curve was indicated as a gamma value. That is, the gamma value was indicated by gamma=(3.0−0.1)/(log (an exposure amount giving a density of 3.0)−log (an exposure amount giving a density of 0.1)). The higher value shows the harder photographic characteristics.

Change in Practical Dmax

The above-mentioned coated samples were each solid-exposed varying a quantity value of light by using an LED light source (Image Setter Genasett DTR-3075, manufactured by Dainippon Screen Mfg. Co., Ltd.), and developed using the developing solution of Table 1 at 35° C. for 15 seconds with an AP-560 automatic processor manufactured by Fuji Photo Film Co., Ltd., followed by fixing, washing and drying. Then, the samples were each developed at a quantity value of light giving a density of a solid area of 4.8 with a flesh solution, and developed with the developing solution after running. A decrease in solid density at this time was taken as ΔDmax.

Processing Unevenness

96% halftone dots on 175 lines per inch were outputted onto each of the samples by using an LED light source (Image Setter Genasett DTR-3075, manufactured by Dainippon Screen Mfg. Co., Ltd.), and developed under the above-mentioned conditions. The processing unevenness was functionally evaluated according to a five-point method grading from 1 (poor) to 5 (good). "3" or less is a level practically coming into question or unavailable.

Running Test

Running tests were conducted with an AP-560 processor manufactured by Fuji Photo Film Co., Ltd. As to the running conditions, 16 sheets of each half-exposed sample of 20×24 inch (50.8 cm×61.0 cm) were processed daily, and this was repeated 6 rounds, regarding as one round the running that the operation was carried out for 6 days and ceased for 1 day. The replenishment rate of the fixing solution in running was 1.5 times that of the developing solution.

The processing was conducted under conditions of a developing time of 15 seconds, a developing temperature of 35° C. and a fixing temperature of 34° C., and as mother liquids, the developing solutions of Table 1 were used as such. The pH of replenishers was adjusted as shown in Table 3. Changes in sensitivity obtained by exhausted solutions after running is practically required to be within ±5.

The dot quality after running was evaluated by outputting 50% halftone dots on 175 lines per inch onto a coated photographic material by using an LED light source (Image Setter Genasett DTR-3075, manufactured by Dainippon Screen Mfg. Co., Ltd.), conducting the development under the above-mentioned conditions, and visually observing the definition of halftone dots with a magnifier having a magnification of ×200. Results of the evaluation are shown in Table 3 by a 5-point method grading from 1 (poor) to 5 (good). Practically, 3 or more is necessary.

A fixing solution having the following formulation was used:

| Formulation of Fixing Solution | |
|---|---|
| Ammonium Thiosulfate | 359.1 g |
| Disodium Ethylenediaminetetraacetate Dihydrate | 0.09 g |
| Sodium Thiosulfate Pentahydrate | 32.8 g |
| Sodium Sulfite | 64.8 g |
| NaOH | 37.2 g |
| Glacial Acetic Acid | 87.3 g |
| Tartaric Acid | 8.76 g |
| Sodium Gluconate | 6.6 g |
| Aluminum Sulfate | 25.3 g |

Water was added to bring the volume to 3 liters, and the pH was adjusted to 4.85 with sulfuric acid or sodium hydroxide.

The results of the evaluations are shown in Tables 2 and 3. The samples for measurement of sensitivity were developed with developing solution 2 in Table 1 at 35° C. for 15 seconds.

TABLE 2

| Coated Sample | Emulsion | Sensitizing Dye | |
|---|---|---|---|
| 1 | A | (1) | 100 |
| 2 | A | (2), (3) | 210 |
| 3 | A | (4) | 180 |
| 4 | B | (1) | 25 |

TABLE 3

| No. | Coated Sample | Hydrazine Derivative (Nucleating Agent) Kind | Amount Added mol/mol-Ag ($\times 10^{-4}$) | Replenisher pH | Developing Solution No. | Developing Solution Replenishment Rate ($ml/m^2$) |
|---|---|---|---|---|---|---|
| 1 | 6 | Compound (3) | 4.5 | 9.7 | 2 | 160 |
| 2 | 7 | Compound (3) | 4.5 | 9.7 | 2 | 160 |
| 3 | 6 | Compound (15) | 4.5 | 9.7 | 2 | 160 |
| 4 | 7 | Compound (15) | 4.5 | 9.7 | 2 | 160 |
| 5 | 8 | Compound (15) | 4.5 | 9.7 | 2 | 160 |
| 6 | 6 | Compound (15) | 4.5 | 9.7 | 1 | 160 |
| 7 | 7 | Compound (15) | 4.5 | 9.7 | 1 | 160 |
| 8 | 6 | Compound (16) | 5 | 9.7 | 2 | 160 |
| 9 | 7 | Compound (16) | 5 | 9.7 | 2 | 160 |
| 10 | 8 | Compound (16) | 5 | 9.7 | 2 | 160 |
| 11 | 6 | Compound (16) | 5 | 9.7 | 1 | 160 |
| 12 | 7 | Compound (16) | 5 | 9.7 | 1 | 160 |
| 13 | 6 | Compound (16) | 5 | 9.7 | 3 | 160 |
| 14 | 7 | Compound (16) | 5 | 9.7 | 3 | 160 |
| 15 | 6 | Compound (16) | 5 | 10.1 | 2 | 80 |
| 16 | 7 | Compound (16) | 5 | 10.1 | 2 | 80 |
| 17 | 8 | Compound (16) | 5 | 10.1 | 2 | 80 |

| No. | Fresh Solution Sensitivity | Fresh Solution Gamma | Fresh Solution Processing Unevenness | After Running Sensitivity | After Running Gamma | After Running Δ Dmax | After Running Dot Quality | Remark |
|---|---|---|---|---|---|---|---|---|
| 1 | 100 | 18.5 | 4.5 | 95 | 17.0 | 0.3 | 4.0 | Invention |
| 2 | 210 | 18.2 | 4.5 | 205 | 17.2 | 0.3 | 4.0 | Invention |
| 3 | 102 | 18.3 | 4.5 | 98 | 17.3 | 0.2 | 4.0 | Invention |
| 4 | 211 | 18.1 | 4.5 | 207 | 17.3 | 0.2 | 4.0 | Invention |
| 5 | 180 | 17.5 | 2.5 | 175 | 17.0 | 0.9 | 2.0 | Comparison |
| 6 | 100 | 17.5 | 2.5 | 90 | 16.8 | 0.3 | 2.0 | Comparison |
| 7 | 210 | 17.2 | 2.5 | 200 | 16.5 | 0.3 | 2.0 | Comparison |
| 8 | 102 | 19.5 | 5.0 | 98 | 18.0 | 0.1 | 4.5 | Invention |
| 9 | 212 | 20.0 | 5.0 | 208 | 19.0 | 0.1 | 4.5 | Invention |
| 10 | 182 | 19.3 | 2.0 | 159 | 12.0 | 0.8 | 2.0 | Comparison |
| 11 | 100 | 17.9 | 2.0 | 96 | 16.8 | 0.1 | 2.0 | Comparison |
| 12 | 211 | 18.0 | 2.0 | 206 | 17.0 | 0.1 | 2.0 | Comparison |
| 13 | 101 | 20.0 | 5.0 | 96 | 18.5 | 0.1 | 4.5 | Invention |
| 14 | 212 | 19.8 | 5.0 | 207 | 18.5 | 0.1 | 4.5 | Invention |
| 15 | 102 | 19.5 | 5.0 | 98 | 18.3 | 0.1 | 4.5 | Invention |
| 16 | 212 | 20.0 | 5.0 | 207 | 19.5 | 0.1 | 4.5 | Invention |
| 17 | 182 | 19.3 | 2.0 | 177 | 18.0 | 1.0 | 2.0 | Comparison |

<Results>

As shown in Table 2, the results show that the sensitivity differences at 660 nm of the emulsions used in the present invention are twice or more. Only the combined systems using these emulsions according to the present invention reduces processing unevenness, as shown in Table 3. Further, even when the developing solutions have been fatigued, high-contrast images are obtained, a decrease in solid exposure density is small, the dot quality is good, and the processing stability is excellent only in the combinations of the present invention.

EXAMPLE 2

Solid developing agents were used in place of the developing solutions used in Example 1. Developing solutions having the same composition as shown in Table 1 were used, but they were solid developing agents in their kit form.

A method for preparing the solid developing agent is shown below. As to potassium carbonate, sodium carbonate, sodium hydrogencarbonate, sodium erythorbate and sodium sulfite, commercially available industrial products were used as such. Diethylenetriaminepentaacetic acid, N-methyl-p-aminophenol, a compound of general formula (I), potassium bromide, 5-methylbenzotriazole and 1-Phenyl-5-mercaptotetrazole were blended, and compressed by application of pressure with a briquetting machine, followed by crushing. A container for an ND-1S developing agent manufactured by Fuji Photo Film Co., Ltd. was charged with the solid matter of these for 10 liters as the developing solution, and an outlet was sealed with an aluminum seal, thereby preparing the solid developing agent. As a fixing agent, an NF-1S solid fixing agent manufactured by Fuji Photo Film Co., Ltd. was used.

FG-MS manufactured by Fuji Photo Film Co., Ltd. was used for dissolution of the solid developing agents and fixing agent. Experiments were made in the same manner as in Example 1, and results similar to those obtained in Example 1 were obtained.

While the invention has been described in detail and with reference to specific examples thereof, it would be apparent to one skilled in the art that various changes and modifications can be made therein without departing from the spirit and scope thereof.

What is claimed is:

1. A development processing method comprising developing a silver halide photographic material with a developing solution, (i) wherein said silver halide photographic material comprises a support having thereon at least one light-sensitive silver halide emulsion layer and contains:

(a) at least two kinds of light-sensitive silver halide emulsions which are each spectrally sensitized and have sensitivities different from each other with respect to a certain exposure wavelength; and (b) at least one hydrazine derivative in at least one of said silver halide emulsion layer and other hydrophilic colloidal layers, and (ii) wherein said developing solution is substantially free from a dihydroxybenzene compound, has a pH of from 9.0 to 10.5 and contains:

(1) at least one ascorbic acid developing agent and (2) at least one auxiliary developing agent represented by the following general formula (I):

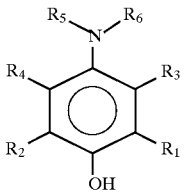

(I)

wherein $R_1$, $R_2$, $R_3$ and $R_4$, which may be the same or different, each represents a hydrogen atom or a substituent group; and $R_5$ and $R_6$, which may be the same or different, each represents an alkyl group, an aryl group, an aralkyl group or a heterocyclic group.

2. The development processing method according to claim 1, wherein said at least two kinds of light-sensitive silver halide emulsions are contained in the same silver halide emulsion layer.

3. The development processing method according to claim 1, wherein said silver halide photographic material comprises a plurality of light-sensitive silver halide emulsion layers, and said at least two kinds of light-sensitive silver halide emulsions are contained in separate layers of said plurality of silver halide emulsion layers.

4. The development processing method according to claim 1, wherein said hydrazine derivative is represented by the following general formula (NB):

$$A\text{-}(B)_m \qquad \text{(NB)}$$

wherein A represents a connecting group, m represents an integer of 2 to 6, and B represents a group represented by the following general formula (B-1):

$$\text{-}(L_2\text{—}Ar_2)_n\text{-}L_1\text{—}Ar_1\text{—}NHNH\text{—}G_1\text{—}R_1 \qquad \text{(B-1)}$$

wherein $Ar_1$ and $Ar_2$ each represents an aromatic group or an aromatic heterocyclic group; $L_1$ and $L_2$ each represents a connecting group; n represents 0 or 1; $R_1$ represents a hydrogen atom, an alkyl group, an aryl group, a heterocyclic group, an alkoxyl group, an aryloxy group, an amino group or a hydrazino group; $G_1$ represents —CO—, —$SO_2$—, —SO—, —P($R_2$)(=O)—, —CO—CO—, a thiocarbonyl group or an iminomethylene group; and $R_2$ is selected from those defined for $R_1$ and may be different from $R_1$.

5. The method according to claim 1, wherein said development is conducted while replenishing said development solution at a replenishment rate of 180 ml or less per 1 $m^2$ of said silver halide photographic material.

6. The method according to claim 1, wherein the pH of said developing solution is from 9.0 to 10.0.

* * * * *